US008690202B2

(12) United States Patent
Lankford

(10) Patent No.: US 8,690,202 B2
(45) Date of Patent: Apr. 8, 2014

(54) CONTROL MECHANISM

(76) Inventor: Mark Lankford, Tyler, TX (US)

( * ) Notice: Subject to any disclaimer, the term of this patent is extended or adjusted under 35 U.S.C. 154(b) by 0 days.

(21) Appl. No.: 13/570,618

(22) Filed: Aug. 9, 2012

(65) Prior Publication Data

US 2014/0042378 A1 Feb. 13, 2014

(51) Int. Cl.
*E05C 3/06* (2006.01)

(52) U.S. Cl.
USPC ..... 292/196; 254/243; 254/246; 49/326; 49/226

(58) Field of Classification Search
USPC ..... 254/228, 243, 246, 261; 49/394, 226, 49/326, 339–341, 345, 333; 292/196
See application file for complete search history.

(56) References Cited

U.S. PATENT DOCUMENTS

| | | | | | |
|---|---|---|---|---|---|
| 131,043 | A | * | 9/1872 | Wooster | 49/326 |
| 380,232 | A | * | 3/1888 | Walker | 49/226 |
| 979,689 | A | * | 12/1910 | Snyder | 49/326 |
| 1,268,427 | A | * | 6/1918 | Blunt | 49/326 |
| 1,382,369 | A | * | 6/1921 | Lind | 49/330 |
| 2,086,061 | A | | 7/1937 | Barr | |
| 2,587,287 | A | | 2/1952 | Chamberlain | |
| 2,629,191 | A | | 2/1953 | Koch et al. | |
| 2,693,653 | A | * | 11/1954 | Dean, Jr. | 49/238 |
| 2,742,722 | A | | 4/1956 | Schaefer | |
| 3,193,955 | A | | 7/1965 | Pitts | |
| 3,199,237 | A | * | 8/1965 | Koch | 49/364 |
| 3,419,302 | A | * | 12/1968 | Frey et al. | 292/189 |
| 3,429,074 | A | * | 2/1969 | Horton | 49/286 |
| 3,497,996 | A | | 3/1970 | Stevens | |
| 3,683,554 | A | | 8/1972 | Romberg | |
| 3,896,588 | A | * | 7/1975 | Doffin et al. | 49/394 |
| 4,145,842 | A | * | 3/1979 | Clugston | 49/364 |
| 4,495,730 | A | * | 1/1985 | Kennedy | 49/280 |
| 4,611,433 | A | * | 9/1986 | Heizer, Jr. | 49/242 |
| 4,638,597 | A | * | 1/1987 | Lybecker | 49/340 |
| 4,703,971 | A | * | 11/1987 | Schmeichel et al. | 296/26.07 |
| 4,805,344 | A | * | 2/1989 | Hrboka | 49/280 |
| 4,850,094 | A | * | 7/1989 | Lybecker | 29/434 |
| 4,870,782 | A | * | 10/1989 | Purves | 49/364 |
| 5,078,461 | A | * | 1/1992 | Beck et al. | 312/331 |
| 5,138,796 | A | * | 8/1992 | Grainger | 49/238 |
| 5,394,651 | A | * | 3/1995 | Vial | 49/394 |
| 5,439,343 | A | * | 8/1995 | Watson | 414/744.3 |
| 5,867,939 | A | * | 2/1999 | Merrill | 49/340 |
| 7,044,534 | B2 | * | 5/2006 | Ishibashi et al. | 296/190.1 |
| 7,182,212 | B2 | * | 2/2007 | Frumau et al. | 212/307 |
| 7,637,541 | B2 | * | 12/2009 | Nesseth | 292/196 |
| 2001/0008057 | A1 | * | 7/2001 | Sakaue et al. | 49/341 |
| 2010/0270814 | A1 | * | 10/2010 | Labarre | 292/144 |

* cited by examiner

*Primary Examiner* — Emmanuel M Marcelo
*Assistant Examiner* — Michael Gallion
(74) *Attorney, Agent, or Firm* — Eric C. Schmalbach

(57) ABSTRACT

A control mechanism has a means for lifting, a lifting cable, and a lifting cable housing. The means for lifting has a control post, and a lift handle attached to a lift body frame about a lift pivot. The lift body frame extends longitudinally perpendicular from the control post. A hydraulic strut extends between an upper lift pivot and a lower lift pivot. A slide rail extends from a roller housing through the slide rail housing. A roller rests between a roller pin and a set pin within the roller housing. A plurality of spacing sliders straddle the slide rail. Removal of one or more of the spacing sliders allows the roller housing and the slide rail to move towards the lift housing member, thereby allowing rotation of the lift body frame and compression of the hydraulic strut.

20 Claims, 26 Drawing Sheets

CONTROL MECHANISM

CROSS REFERENCE TO RELATED APPLICATIONS

This application contains subject matter related to subject matter contained in co-pending U.S. Ser. No. 13/570,582 filed on Aug. 9, 2012 and incorporated herein by reference.

BACKGROUND

Regulated and time-efficient passage through an entrance continues to be a problem. A control mechanism engages an entry system by providing a directional force on a tensile structure, such as a cable. The cable may engage another opening structure such as a latch or other means. It is desirable for a control mechanism to provide secure entrance. Moreover, it is also desirable for a control mechanism to allow the cable to return to a first locked position over a period of time, without further interaction from an operator. Therefore, a need exists for an improved control mechanism for applying a directional force on a tensile structure, and allowing such tensile structure to return to a first position over a period of time, without further interaction from the operator.

SUMMARY

The present invention is directed towards an apparatus applying a directional force on a tensile structure, and allowing such tensile structure to return to a first position over a period of time, without further interaction from the operator. In a preferred embodiment, a control mechanism has a means for lifting. The means for lifting may be attached to a lifting cable extending through a lifting cable housing. The means for lifting has a control post, and a lift handle attached to a lift body frame about a lift pivot. The lift body frame extends longitudinally perpendicular from the control post. An at least one spring mechanism is attached at one end to the lift body frame, and an opposing end is attached to the lifting cable. An upper lift pivot is attached to the lift body frame. A lower lift pivot attached to the control post. A hydraulic strut extends between the upper lift pivot and the lower lift pivot. A lift housing member is attached at an upper portion of the control post. The lift housing member has a slide rail housing. A slide rail extends from a roller housing through the slide rail housing. A roller rests between a roller pin and a set pin within the roller housing. A set plate is attached to the lift body frame. A lock pin extends longitudinally perpendicular from the set plate for engagement in a recess cavity. The recess cavity is located on an outer surface of the roller housing. A plurality of spacing sliders straddle the slide rail. Removal of one or more of the spacing sliders allows the roller housing and the slide rail to move towards the lift housing member, thereby allowing rotation of the lift body frame and compression of the hydraulic strut. Replacement of one or more of the spacing sliders allows the roller housing and slide rail to move away from the lift housing member, thereby allowing rotation of the lift body frame and decompression of the hydraulic strut. Further rotation of the lift body frame causes the lock pin to move into a locked position within the roller housing.

The preferred embodiment may additionally comprise a latching system. The latching system includes an upright support post, and a gate pivotably mounted to the upright support post. The gate has a gate support side and gate latching side. A latching post is fixedly attached to the ground and extends longitudinally parallel to the upright support post. A latch pin housing is fixedly attached to the gate latching side, and a latch pin longitudinally extends from the latch pin housing. A housing member is fixedly attached to the latching post. A mechanical latch is located within the housing member, further comprising a first latch plate and second latch plate. The first latch plate and second latch plate each define stopping surfaces, apertures, and angled surfaces.

The latch pin is located between the first latch plate and the second latch plate in a closed position of the gate. The lifting cable extends from the lifting means through the lifting cable housing to either the first latch plate or the second latch plate. Activation of the lifting means causes the lifting cable to contract towards the lifting means, thereby elevating either first latch plate or second latch plate within the housing member. Elevation of either first latch plate or second latch plate allows the latch pin to exit the housing member, thereby allowing the gate to move to an open position. Release of the lifting means causes the lifting cable to retract away from the lifting means over a predetermined time period, thereby causing either the first latch plate or second latch plate to descend into the housing member.

BRIEF DESCRIPTION OF THE DRAWINGS

These and other features, aspects and advantages of embodiments of the invention will become better understood with regard to the following description, appended claims, and accompanying drawings where:

DETAILED DESCRIPTION

Figure 1:
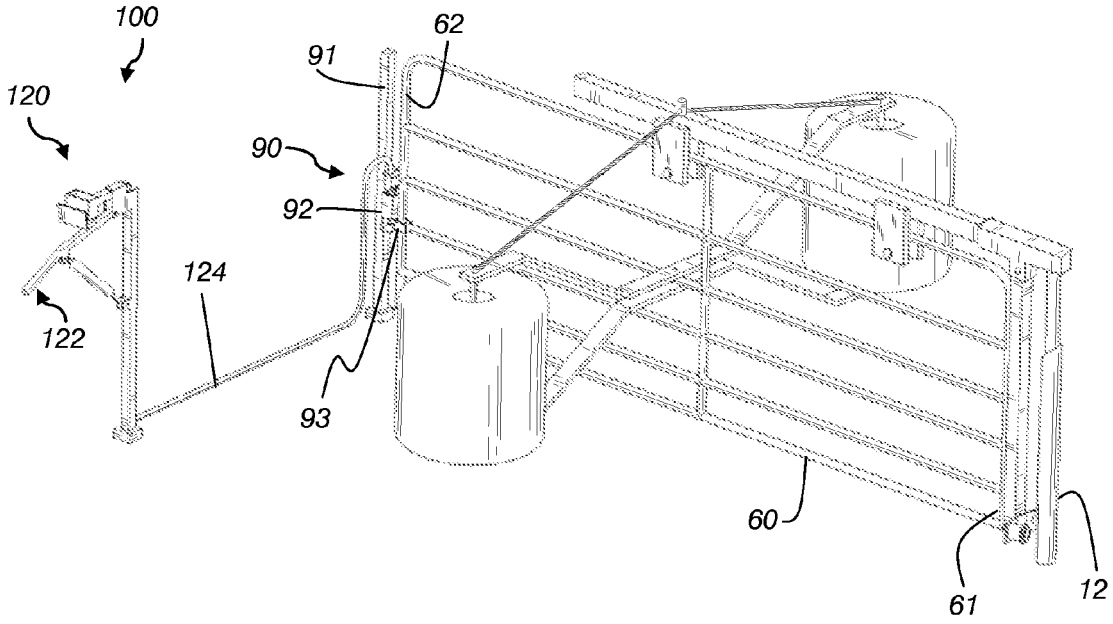
FIG. 1 is a perspective view of a control mechanism, according to an embodiment of the invention.

Referring to FIGS. 9-21, a control mechanism 100 has a means for lifting 122. The means for lifting 122 may be attached to a lifting cable 123, extending through a lifting cable housing 124. The means for lifting 122 has a control post 121, and a lift handle 141 attached to a lift body frame 146 about a lift pivot 155. The lift body frame 146 extends longitudinally perpendicular from the control post 121. An at least one spring mechanism 168 is attached at one end to the lift body frame 146, and an opposing end is attached to the lifting cable 123. An upper lift pivot 142 is attached to the lift body frame 146. A lower lift pivot 143 is attached to the control post 121. A hydraulic strut 150 extends between the upper lift pivot 142 and the lower lift pivot 143. A lift housing member 144 is attached at an upper portion of the control post 121. The lift housing member 144 has a slide rail housing 161.

A slide rail 161*a* extends from a roller housing 163 through the slide rail housing 161. A roller 170 rests between a roller pin 174 and a set pin 172 within the roller housing 163. A set plate 165 is attached to the lift body frame. A lock pin 177 extends longitudinally perpendicular from the set plate 165 for engagement in a recess cavity 173. The recess cavity 173 is located on an outer surface of the roller housing 163. A plurality of spacing sliders 171 straddle the slide rail 161*a*. Removal of one or more of the spacing sliders 171 allows the roller housing 163 and the slide rail 161*a* to move towards the lift housing member 144, thereby allowing rotation of the lift body frame 146 and compression of the hydraulic strut 150.

Replacement of one or more of the spacing sliders 171 allows the roller housing 163 and slide rail 161*a* to move away from the lift housing member 146, thereby allowing rotation of the lift body frame 146 and decompression of the hydraulic strut 150. Further rotation of the lift body frame 146 causes the lock pin 177 to move into a locked position within the roller housing 163. Lifting means 122, provides lift to lifting cable 123 upon engagement of control structure 120.

Figure 9:
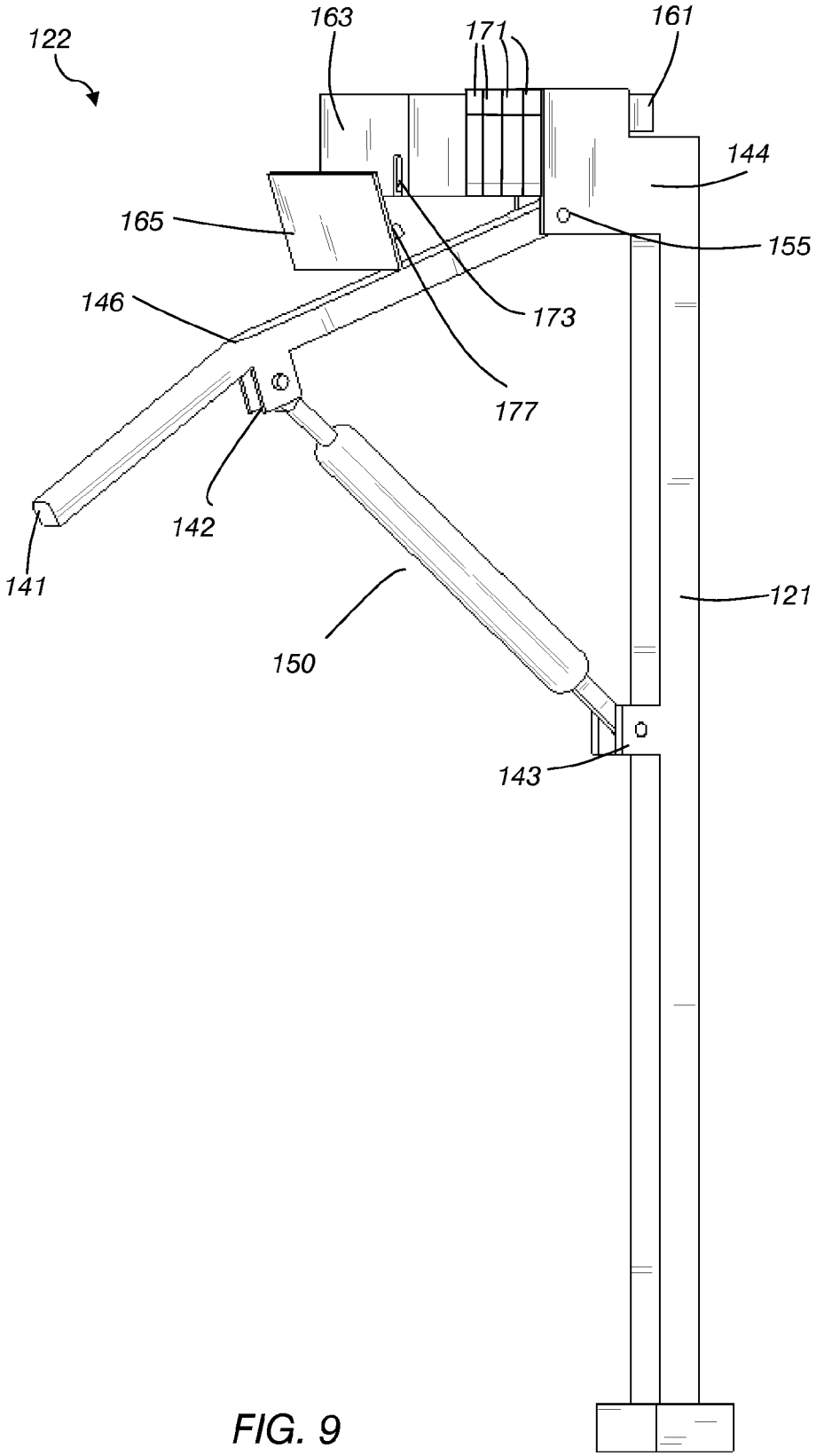
FIG. 9 is a perspective view of a lifting means, showing activation, according to the embodiment of FIG. 1.

Referring to FIG. 9, lift handle 141 and lift body frame 146 extend longitudinally perpendicular from control post 121, and rotate about rotation pin 155. Hydraulic strut 150 extends between upper lift pivot 142 and lower lift pivot 143. Slide rail 161*a* extends from roller housing 163 through lift housing member 144. Four spacing sliders 171 (although differing numbers of spacing sliders are contemplated) are fastened to slide rail 161*a*, between roller housing 163 and lift housing member 144. Set plate 165 is fixedly attached to lift body frame 146. Lock pin 177 extends longitudinally perpendicular from set plate 165, aligned for engagement into recess cavity 173.

Figure 10:
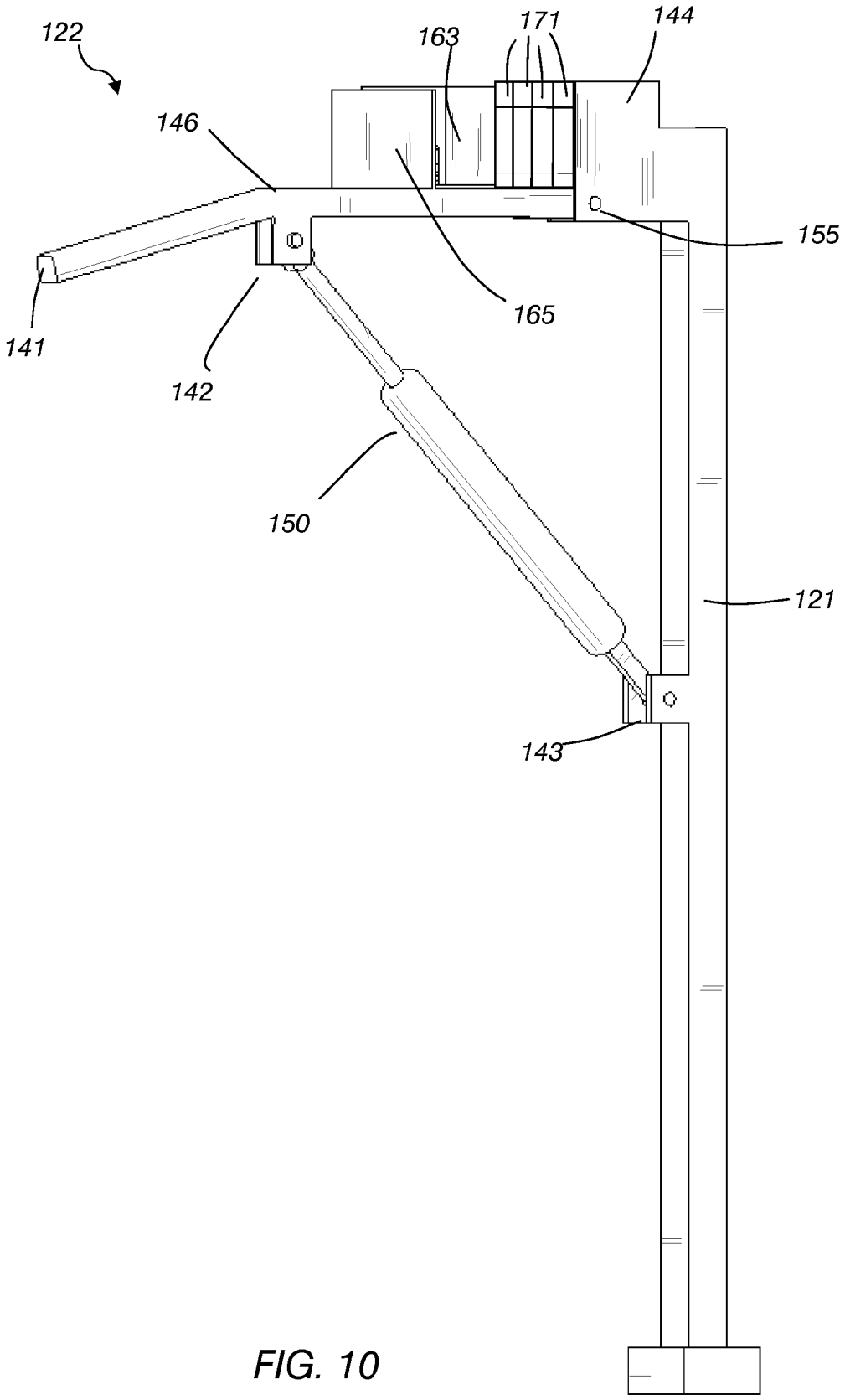
FIG. 10 is a perspective view of a lifting means according to the embodiment of FIG. 1.

Referring to FIG. 10, upon closing, set plate 165 rests against roller housing 163, and lock pin 177 extends through recess cavity 173. FIGS. 11A-11F illustrate movement of lifting means 122 before and during activation of control structure 120.

Figure 11A:
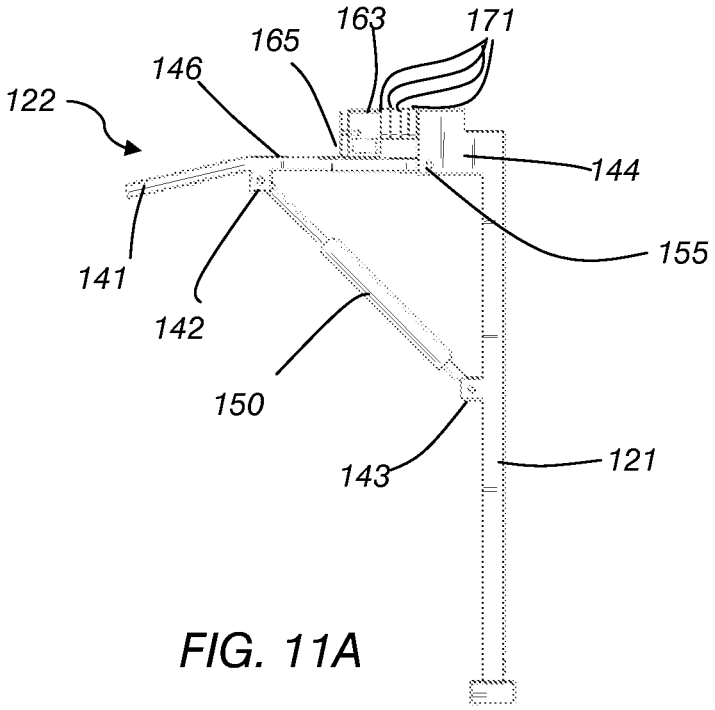
FIG. 11A is a partial cross-sectional side view of a lifting means, according to the embodiment of FIG. 1.

FIG. 11A illustrates lifting means 122 before activation. Lift handle 141 and lifting body frame 146 rest in upward position, with set plate 165 resting against roller housing 163. Lock pin 177 rests upon roller 170. Four sliding spacers 171 exist along slide rail 161*a*.

Figure 11B:
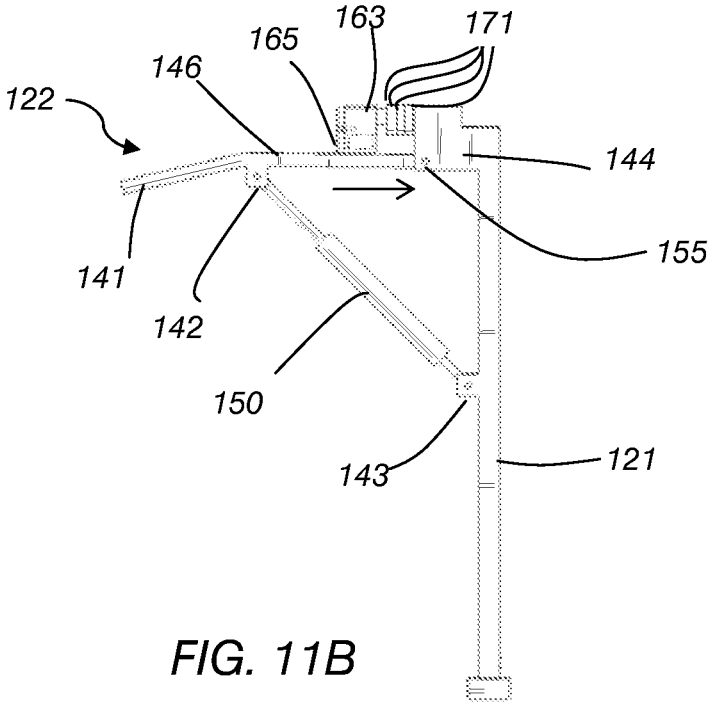
FIG. 11B is a partial cross-sectional side view of a lifting means, showing removal of a sliding spacer, according to the embodiment of FIG. 1.

Referring to FIG. 11B, one sliding spacer 171 is then removed, and roller housing 163 is pushed forward, towards lift housing member 144. Set plate 165 and lock pin 177 are thereby offset a distance from roller housing 163.

Figure 11C:
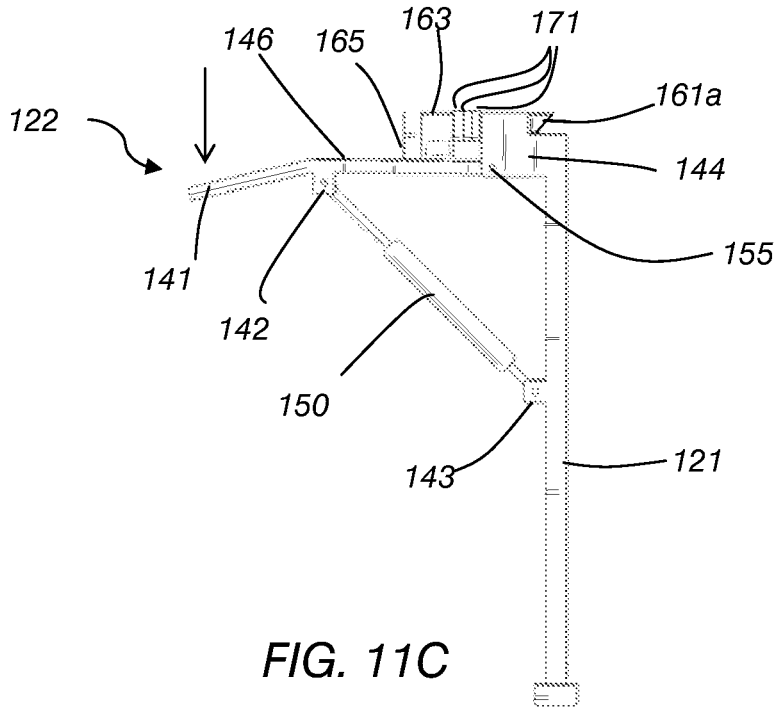
FIG. 11C is a partial cross-sectional side view of a lifting means, showing movement of a roller housing after removal of a sliding spacer, according to the embodiment of FIG. 1.
Figure 11D:
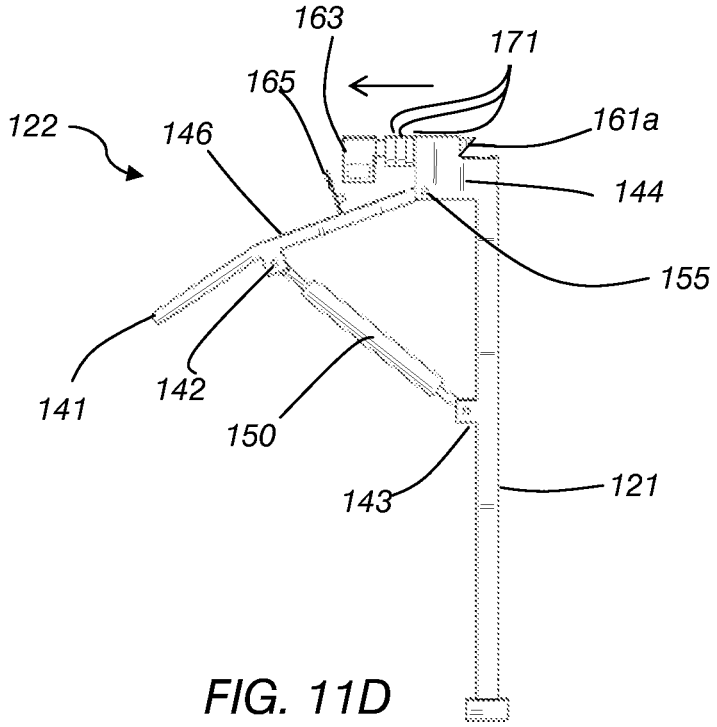
FIG. 11D is a partial cross-sectional side view of a lifting means, showing movement of a lift handle, according to the embodiment of FIG. 1.

Referring to FIG. 11C a downward force is then applied to lift handle 141 and lifting body frame 146. Referring to FIG. 11D, downward force causes lift handle 141, set plate 165, lock pin 177, and lift body frame 146 to rotate downward, as hydraulic strut 150 is compressed.

Figure 11E:
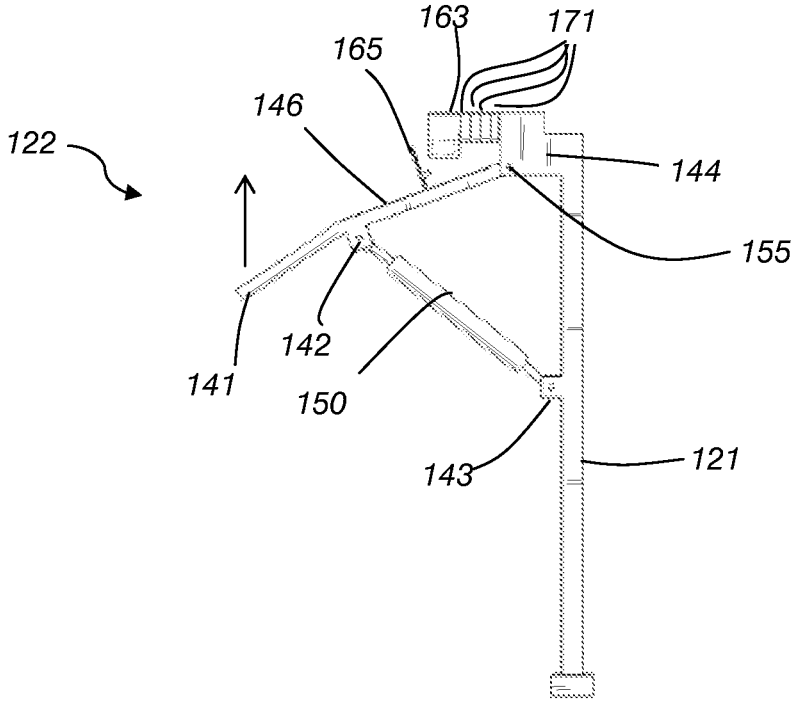
FIG. 11E is a partial cross-sectional side view of a lifting means, showing replacement of a sliding spacer, according to the embodiment of FIG. 1.

Referring to FIG. 11E, roller housing 163 is pushed backwards, away from housing member 144. The removed spacing slider 171 is replaced into position on slide rail 161. Hydraulic strut 150 decompresses, causing lift handle 141, set plate 165, lock pin 177, and lift body frame 146 to rotate upwards.

Figure 11F:
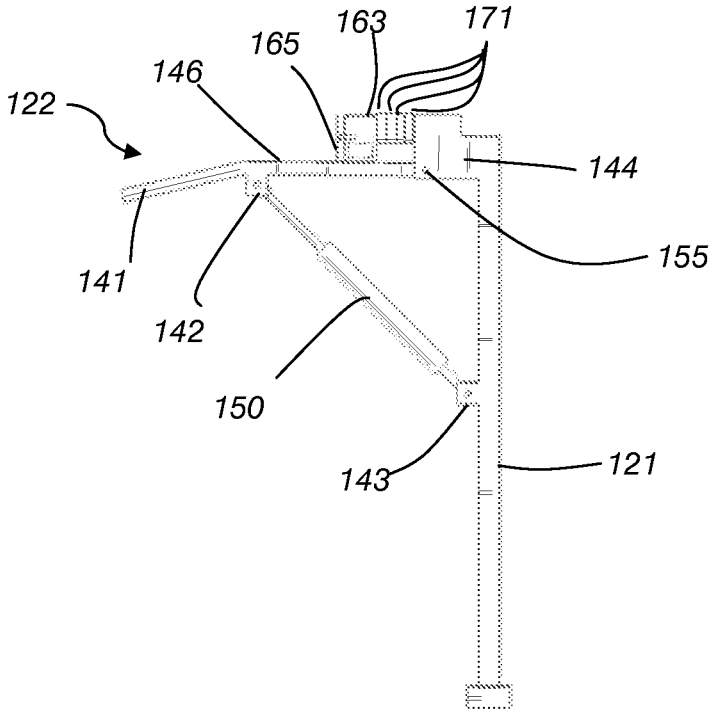
FIG. 11F is a partial cross-sectional side view of a lifting means, showing lifting means in a locked position, according to the embodiment of FIG. 1.

Referring to FIG. 11F, lift handle 141, set plate 165, lock pin 177, and lift body frame 146 then rise back to resting position.

Figure 12:
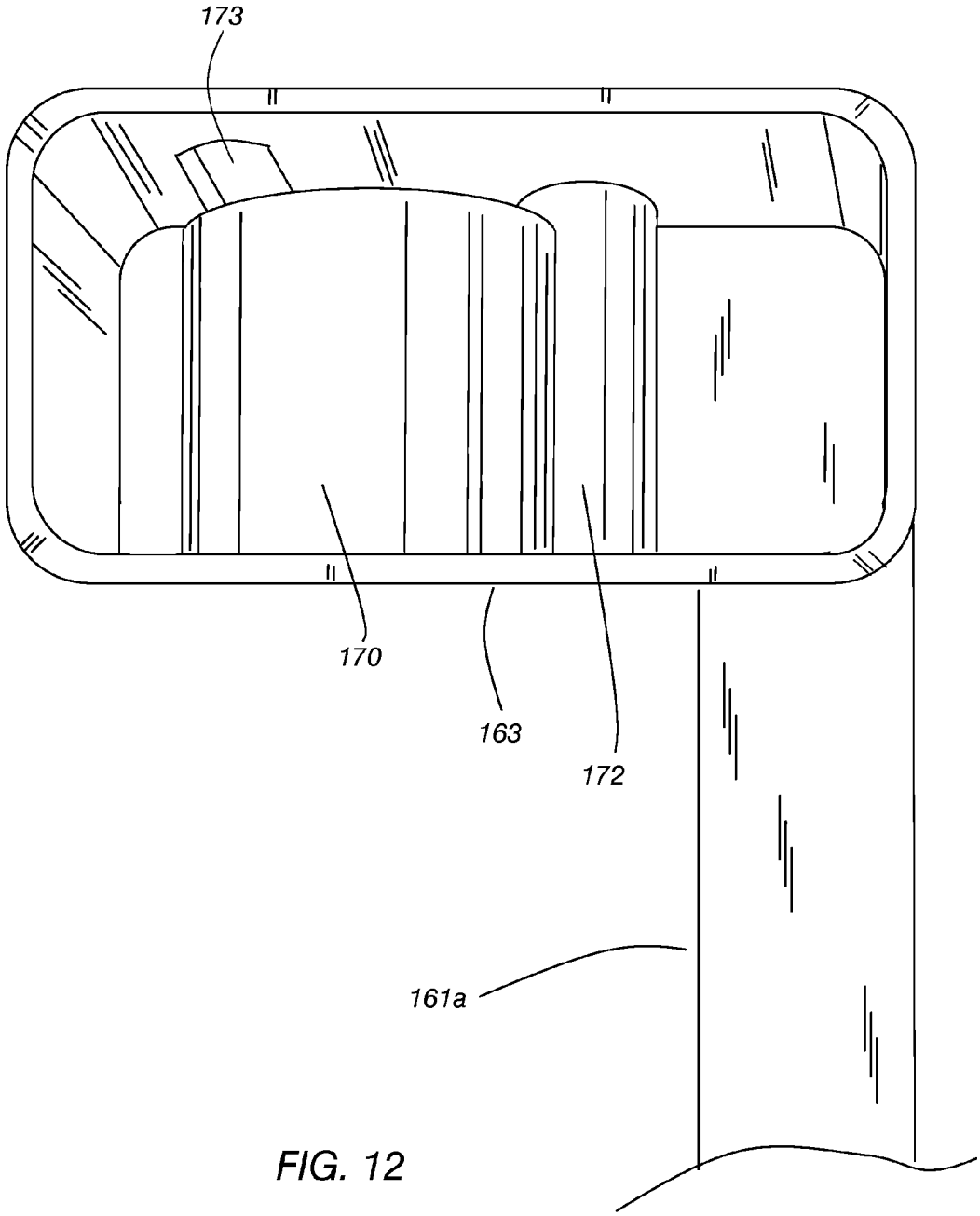
FIG. 12 is a top view of a roller housing, according to the embodiment of FIG. 1.

FIG. 12 illustrates a top view of roller housing member 163, when lift handle 141, set plate 165, lock pin 177, and lift body frame 146 are axially rotated downward (as shown in FIG. 11D and FIG. 11E). Roller 170 rests against set pin 172 and lower surface of roller housing member 163. Roller pin 172 and set pin 172, allow rotation of roller 170, however, are spaced such as to prohibit precession of roller 170 over roller pin 172.

Figure 13:
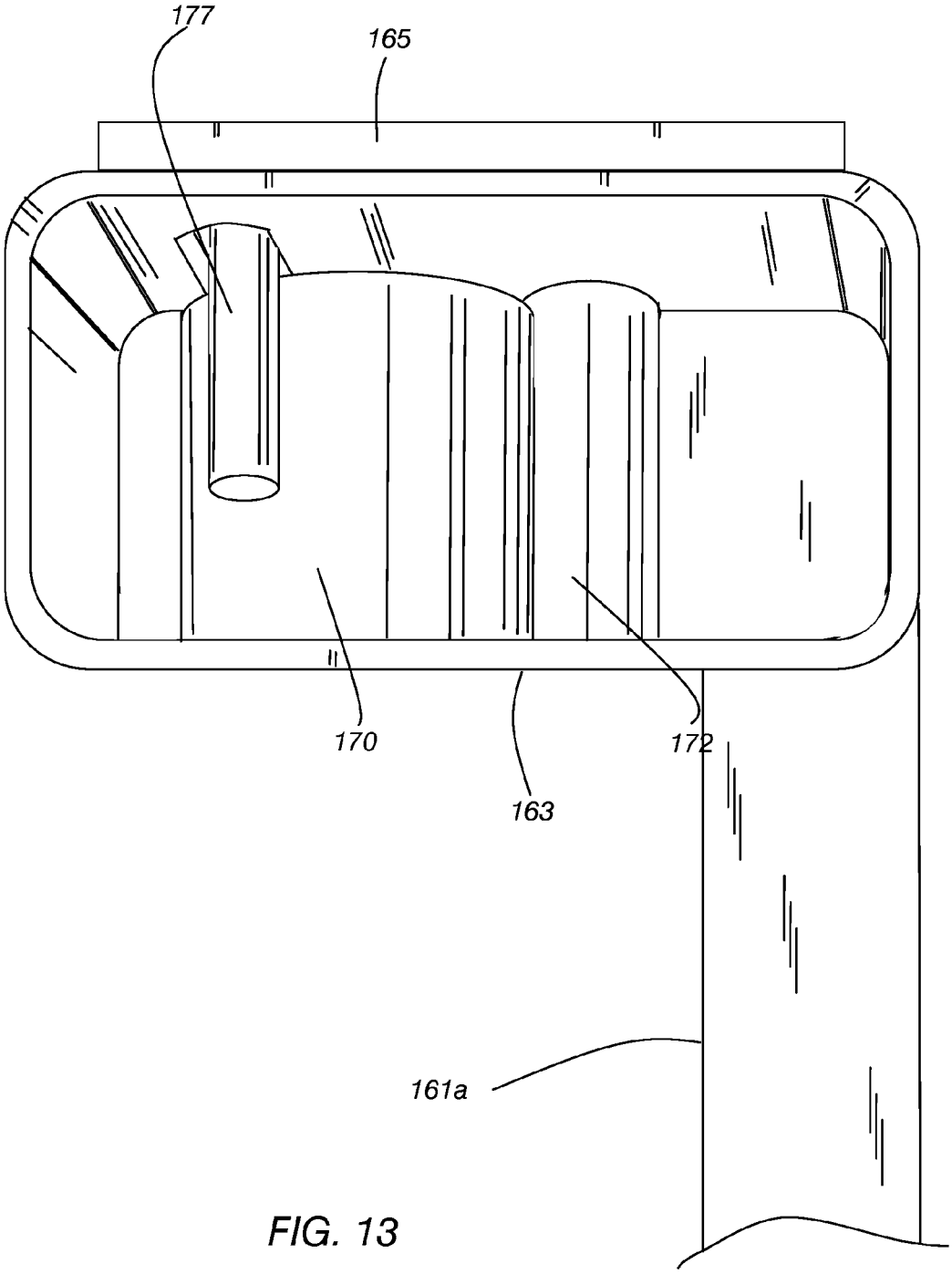
FIG. 13 is a top view of a roller housing, showing engagement of a locking pin, according to the embodiment of FIG. 1.
Figure 14:
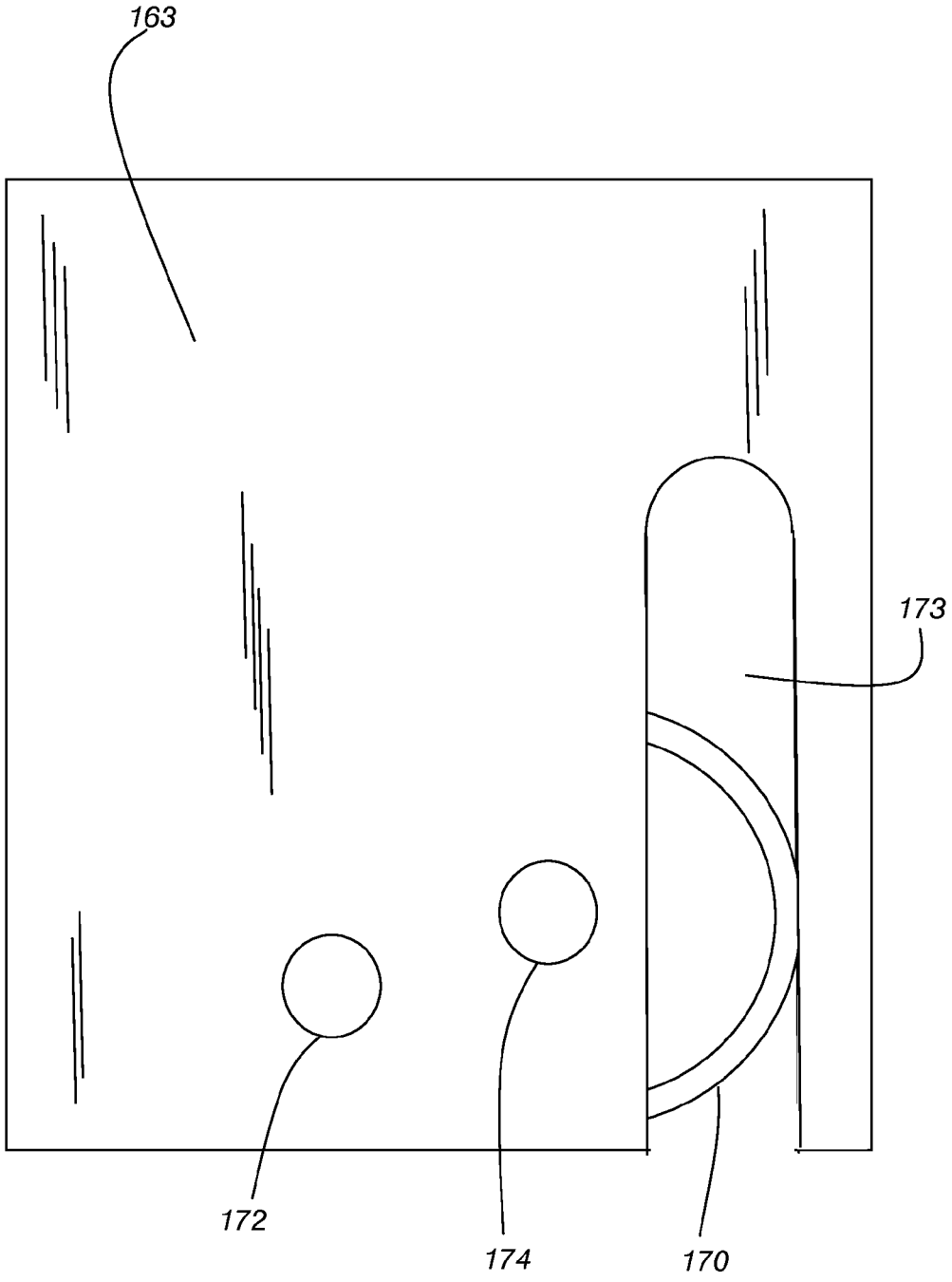
FIG. 14 is a front view of a roller housing, according to the embodiment of FIG. 1.
Figure 15:
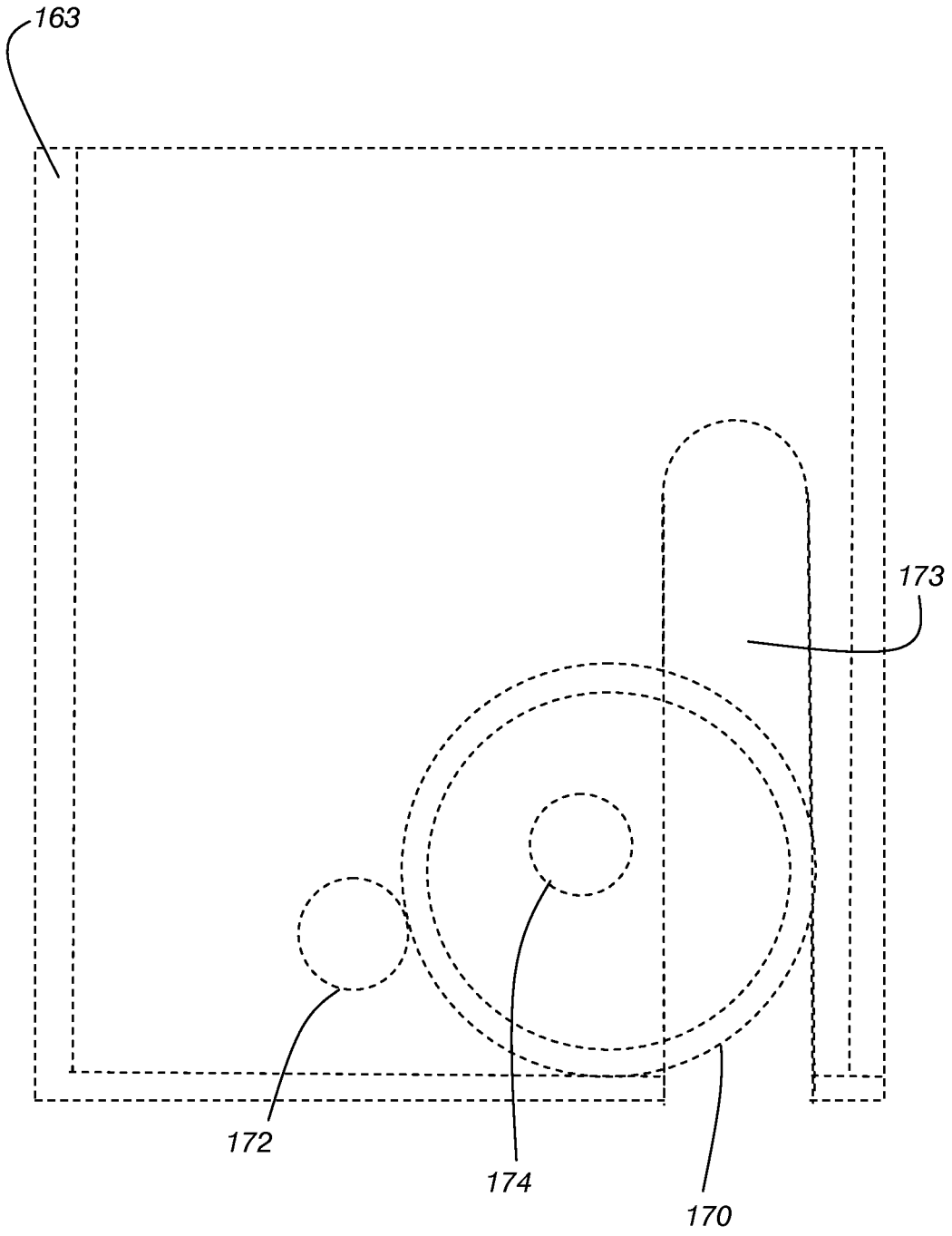
FIG. 15 is a front cross-sectional view of a roller housing, according to the embodiment of FIG. 1.
Figure 16:
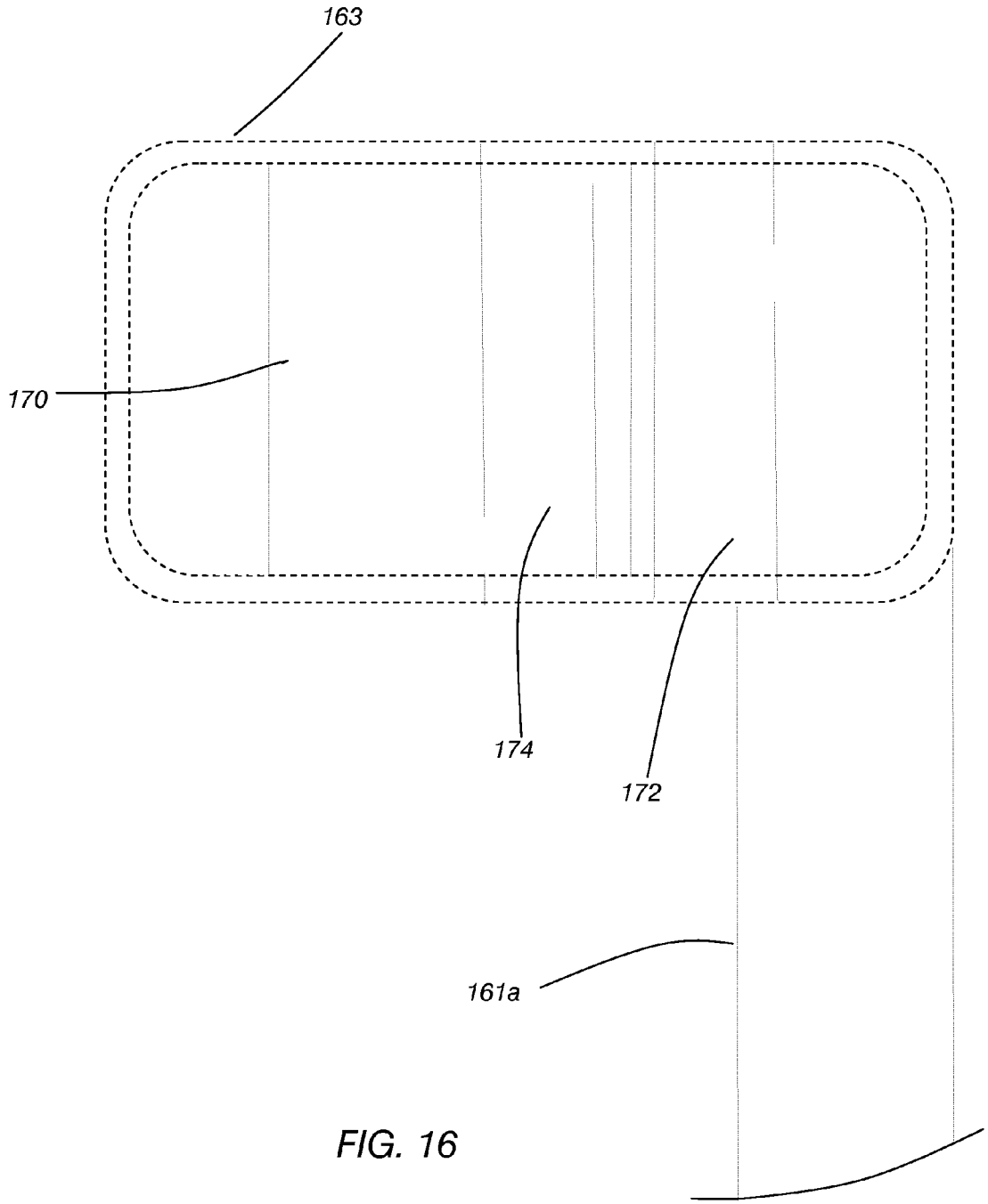
FIG. 16 is a top cross-sectional view of a roller housing, according to the embodiment of FIG. 1.
Figure 17:
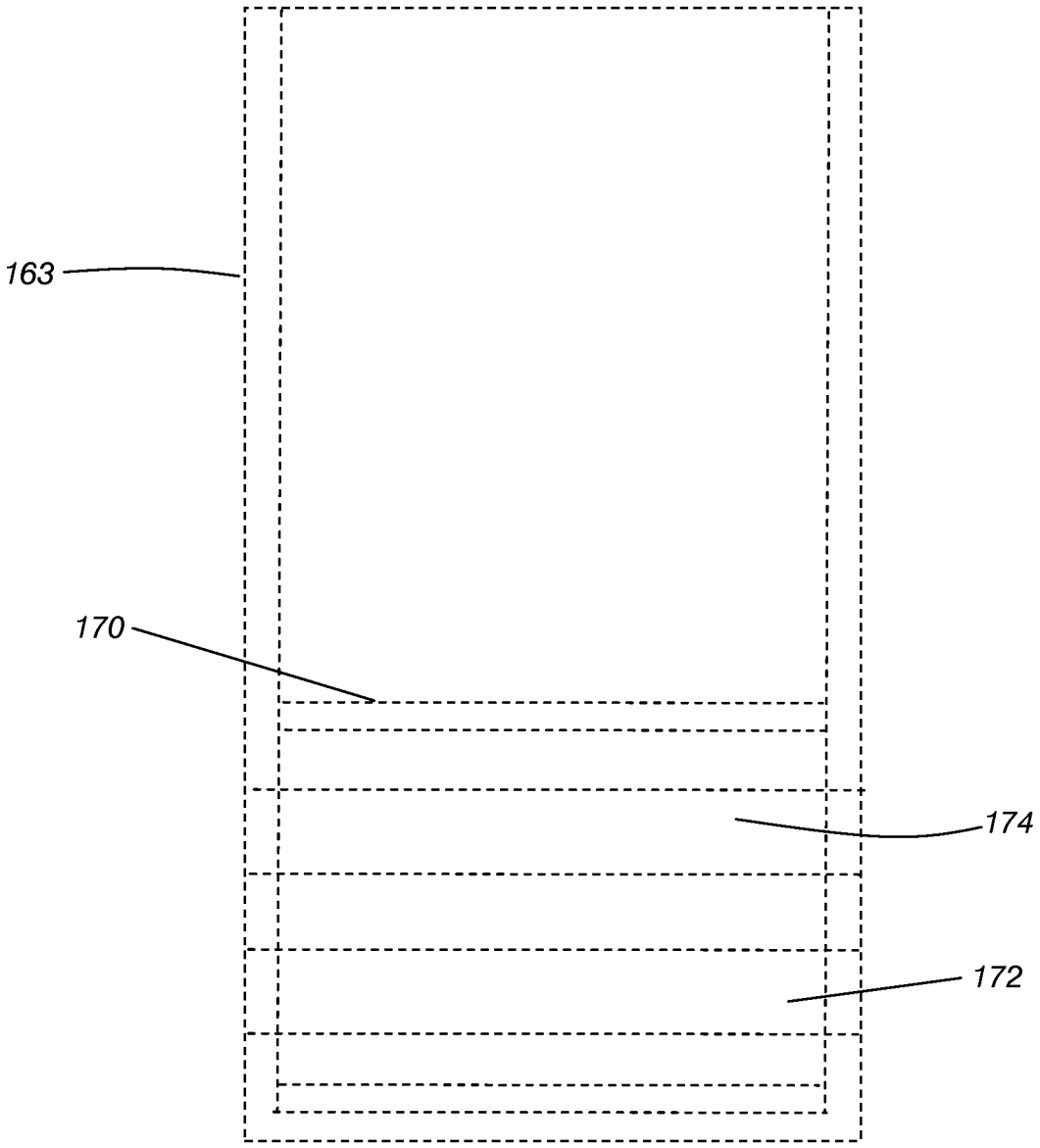
FIG. 17 is a side cross-sectional view of a roller housing, according to the embodiment of FIG. 1.
Figure 18:
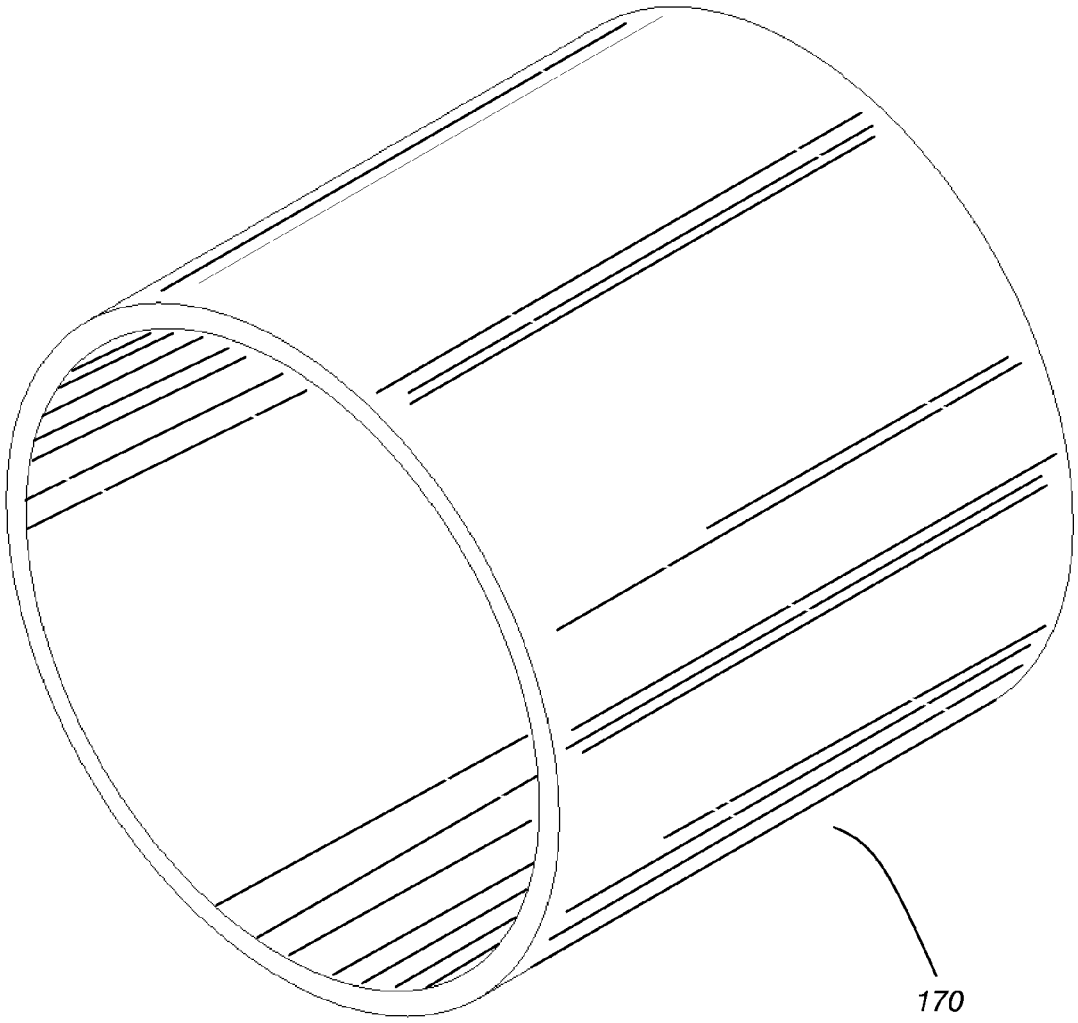
FIG. 18 is a perspective view of a roller, according to the embodiment of FIG. 1.
Figure 19:
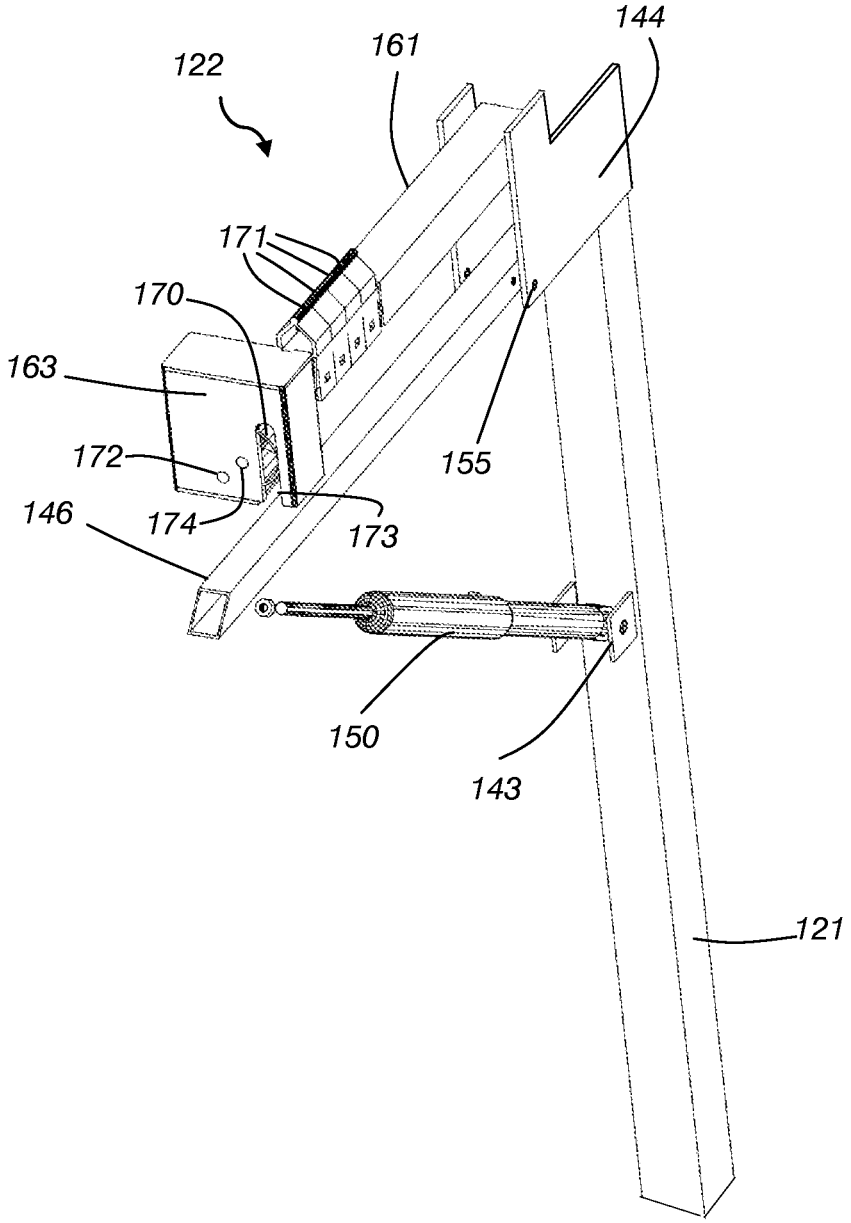
FIG. 19 and FIG. 20 are partial exploded perspective views of a lifting means, according to the embodiment of FIG. 1.
Figure 20:
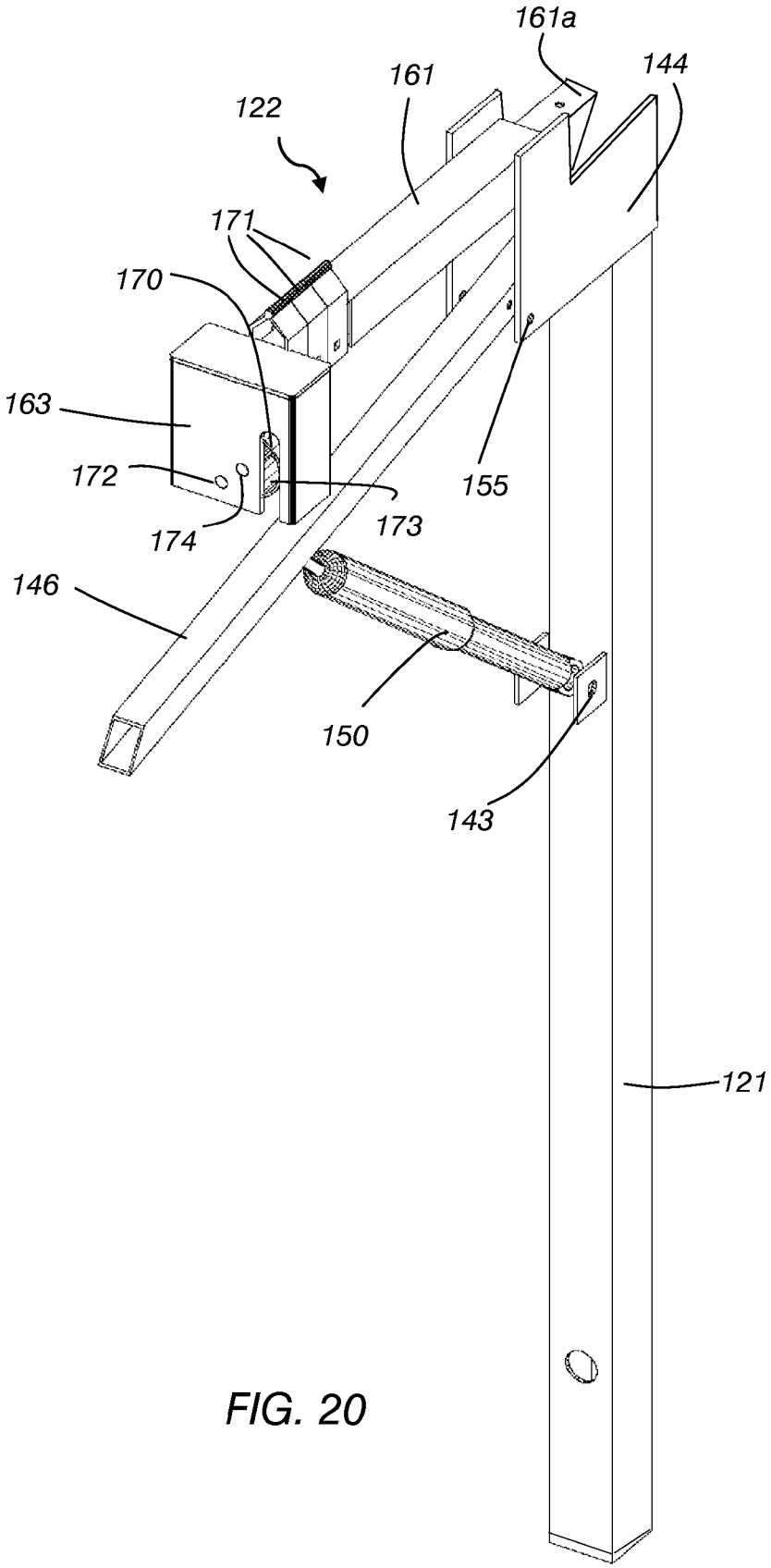
Figure 21:
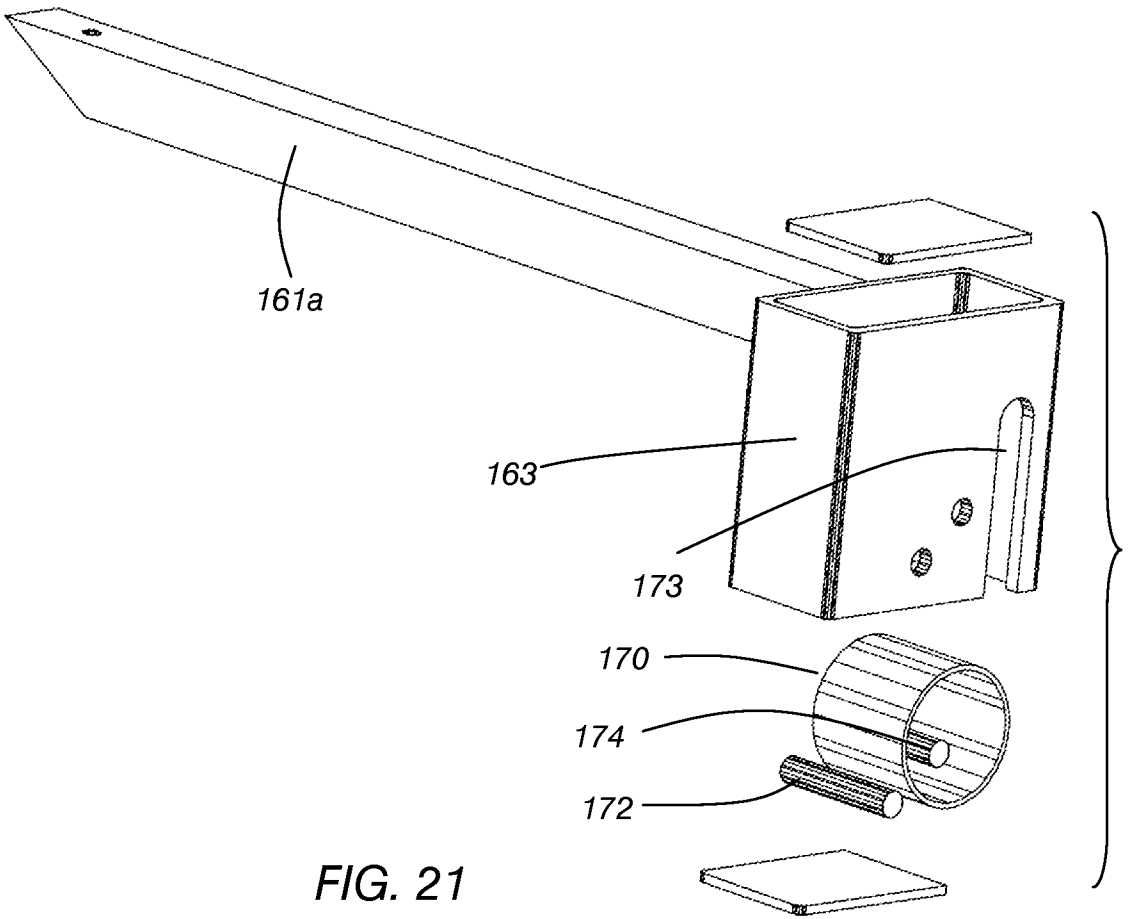
FIG. 21 is an exploded perspective view of a roller housing, according to the embodiment of FIG. 1.

FIG. 13 illustrates a top view of roller housing member 163, when lift handle 141, set plate 165, lock pin 177, and lift body frame 146 are axially rotated upward and locked (as shown in FIG. 11A, FIG. 11B and FIG. 11F). Roller 170 rests against set pin 172 and lower surface of roller housing member 163. Lock pin 177 extends through recess cavity 173, and rests on upper surface of roller 170. Set plate 165 rests against roller housing member 163.

Lifting means 122 allows an operator to lock the control structure 120. In the locked position, any type of suitable locking device may be added to spacing sliders 171. Removal of spacing sliders 171 allows roller housing to be extended towards lift housing member 144, causing set plate 165 and lock pin 177 to be released. Rotation of set plate 165 and lock pin 177 in is then permitted. The operator then applies a downward force on lift handle 141. The removed spacing sliders 171 (and locking device) are then replaced. The decompression of the hydraulic strut 150 allows the lift handle 141, set plate 165, lock pin 177, and lift body frame 146 to rotate upwards at the rate of decompression of hydraulic strut 150. In the preferred embodiment, the rate of decompression of the hydraulic strut 150 may last up to 10 seconds or more, allowing the operator time to travel through the entrance, before the lifting cable 123 descends.

As the lift handle 141, set plate 165, lock pin 177, and lift body frame 146 rotate upwards, lock pin 177 enters the recess cavity 173, while a horizontal distance exists between set plate 165 and roller housing member 163. Lock pin 177 then travels along outer periphery of roller 170, at the same time set plate 165 ascends towards roller housing member 163. As set plate 165 is raised against roller housing member, lock pin 177 slides on top of roller 170. Lock pin 177 is then locked into position.

Referring to FIG. 1, the control mechanism may additionally comprise a means for latching 90. the preferred embodiment sets forth implementation of a means for latching 90 in connection with a gate 60. In the example of a implementation of the means for latching 90 on a gate 60, an upright support post 12 extends longitudinally perpendicular relative to the ground. Upright support post 12 is a hollow rigid body, and is fixedly set into a corresponding post hole with concrete. Gate 60 extends longitudinally perpendicular relative to upright support post 12. Gate 60 is a rigid, substantially planar member, further defined by a gate support side 61 and gate latch side 62. The gate of the preferred embodiment is a horizontally swinging type gate.

Figure 2:
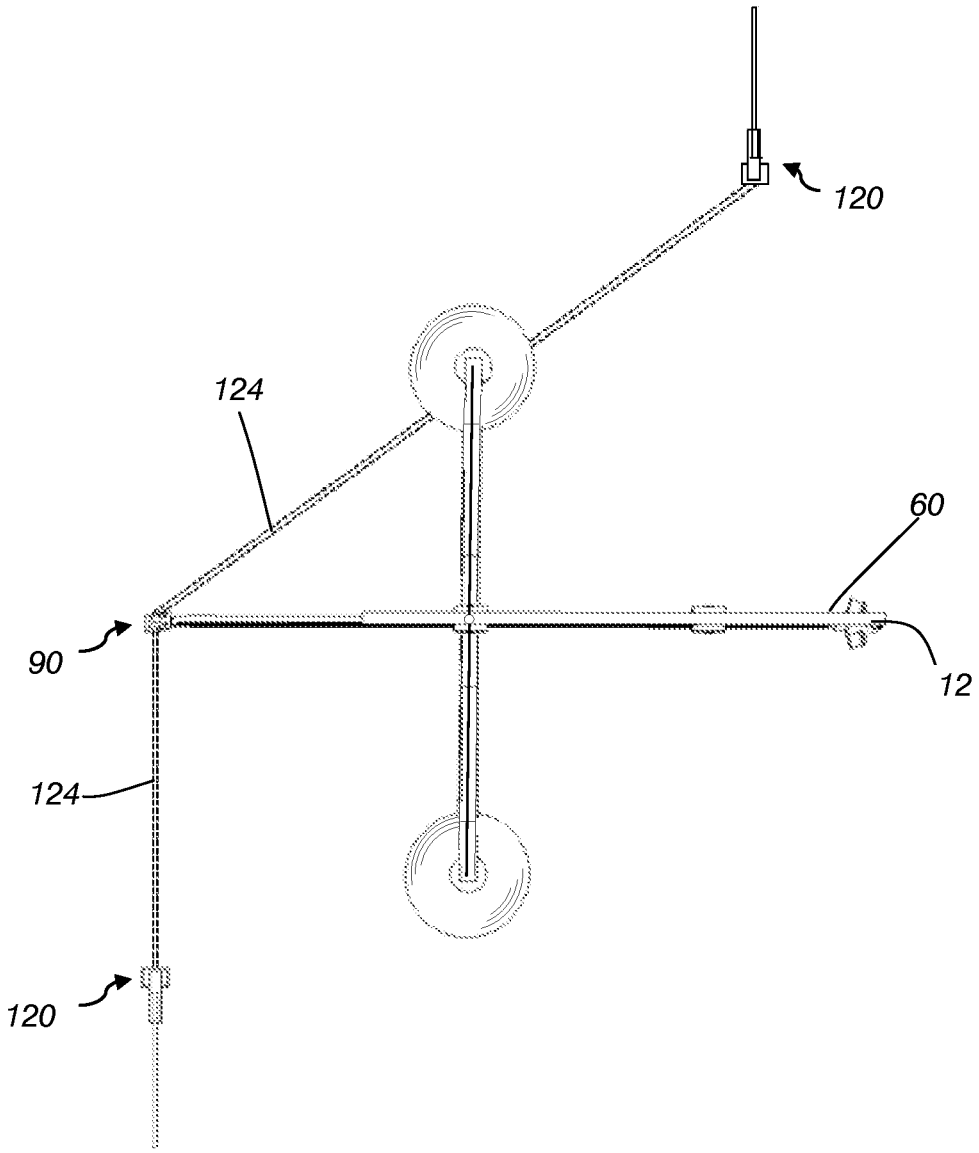
FIG. 2 is a top plan view of a control mechanism, showing control structures at either side of a gate, according to the embodiment of FIG. 1.
Figure 6:
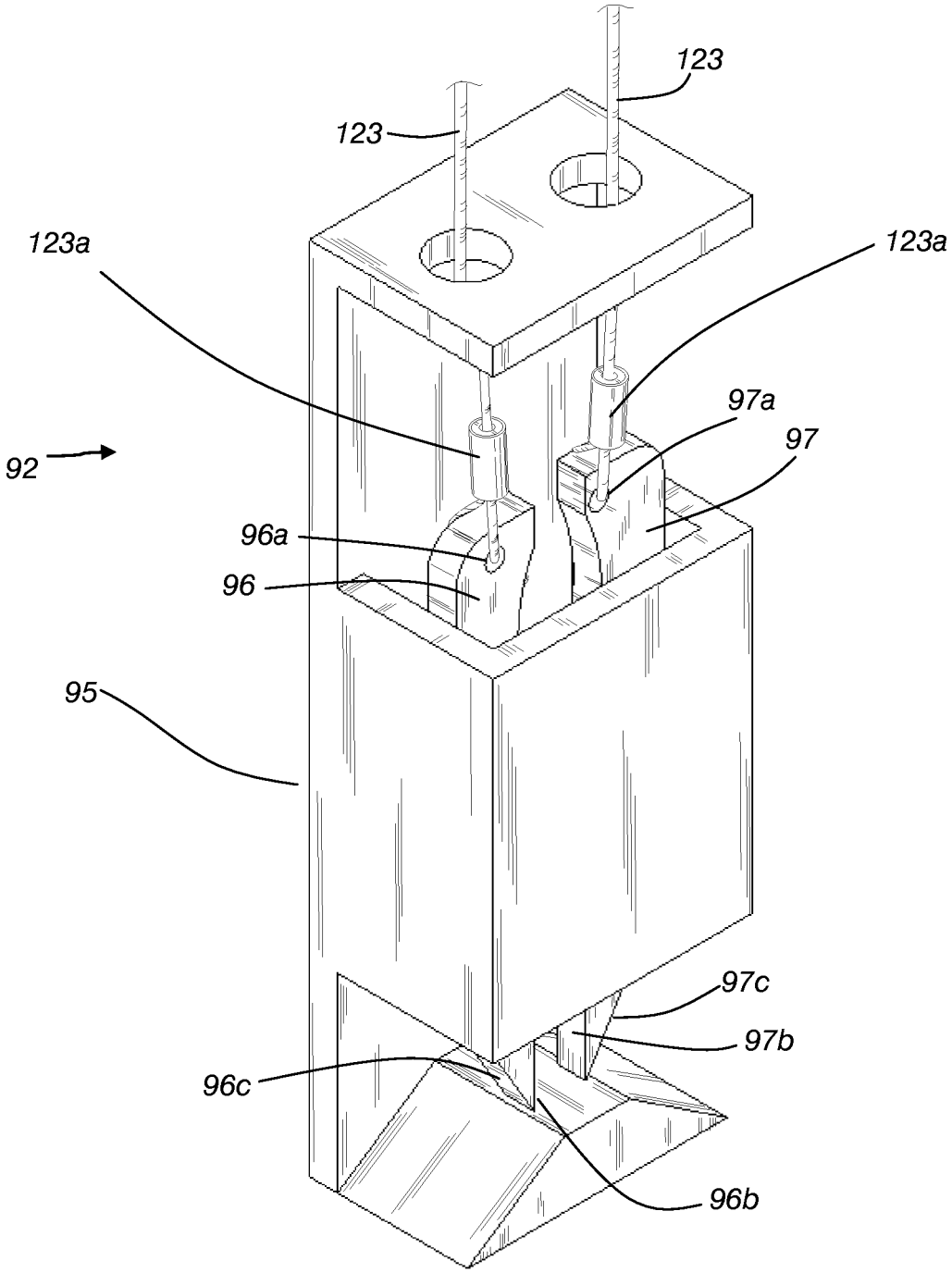
FIG. 6 is a perspective view of a means for latching according to the embodiment of FIG. 1.
Figure 7:
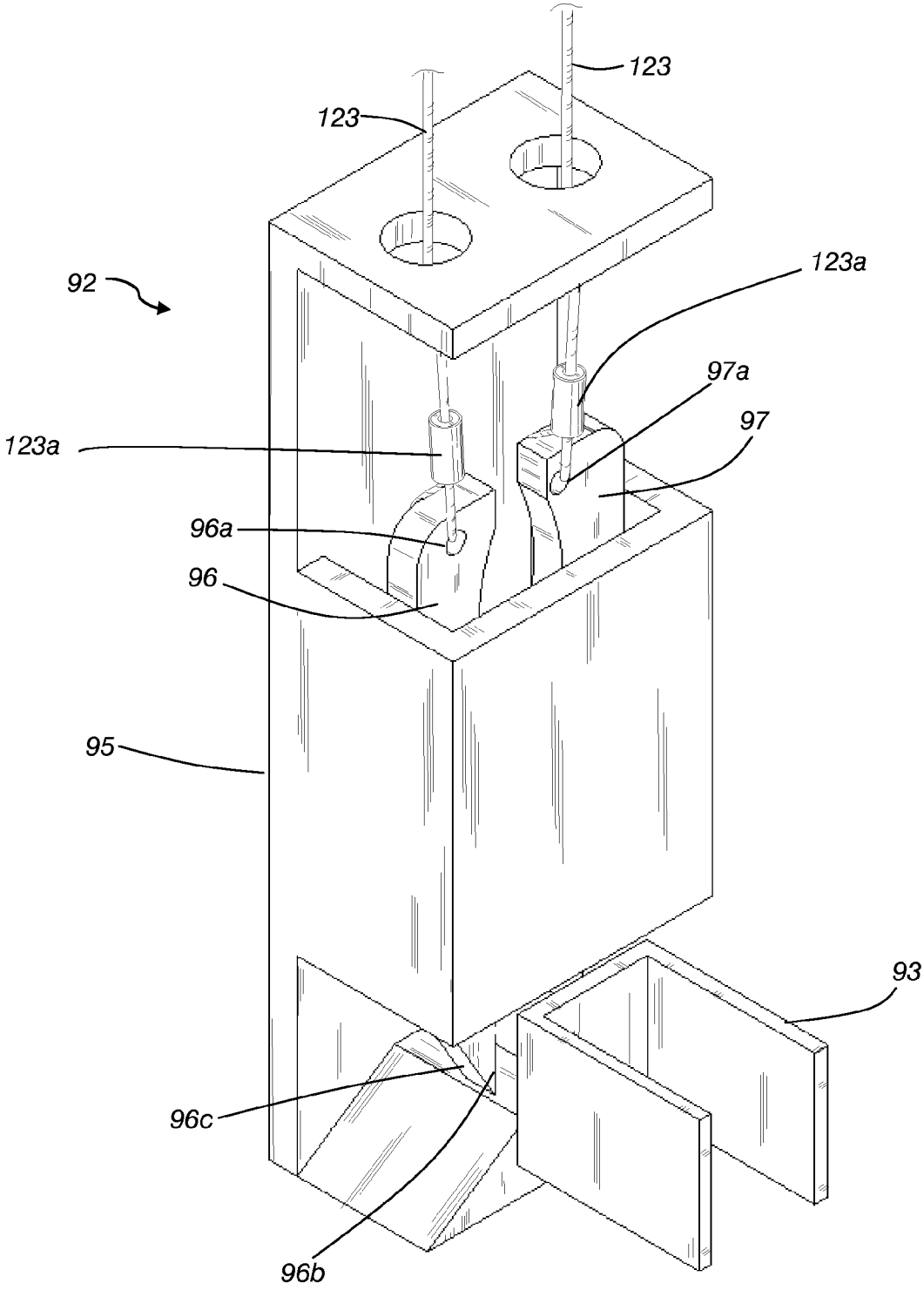
FIG. 7 is a perspective view of a means for latching, showing the latch pin housing, according to the embodiment of FIG. 1.
Figure 8:
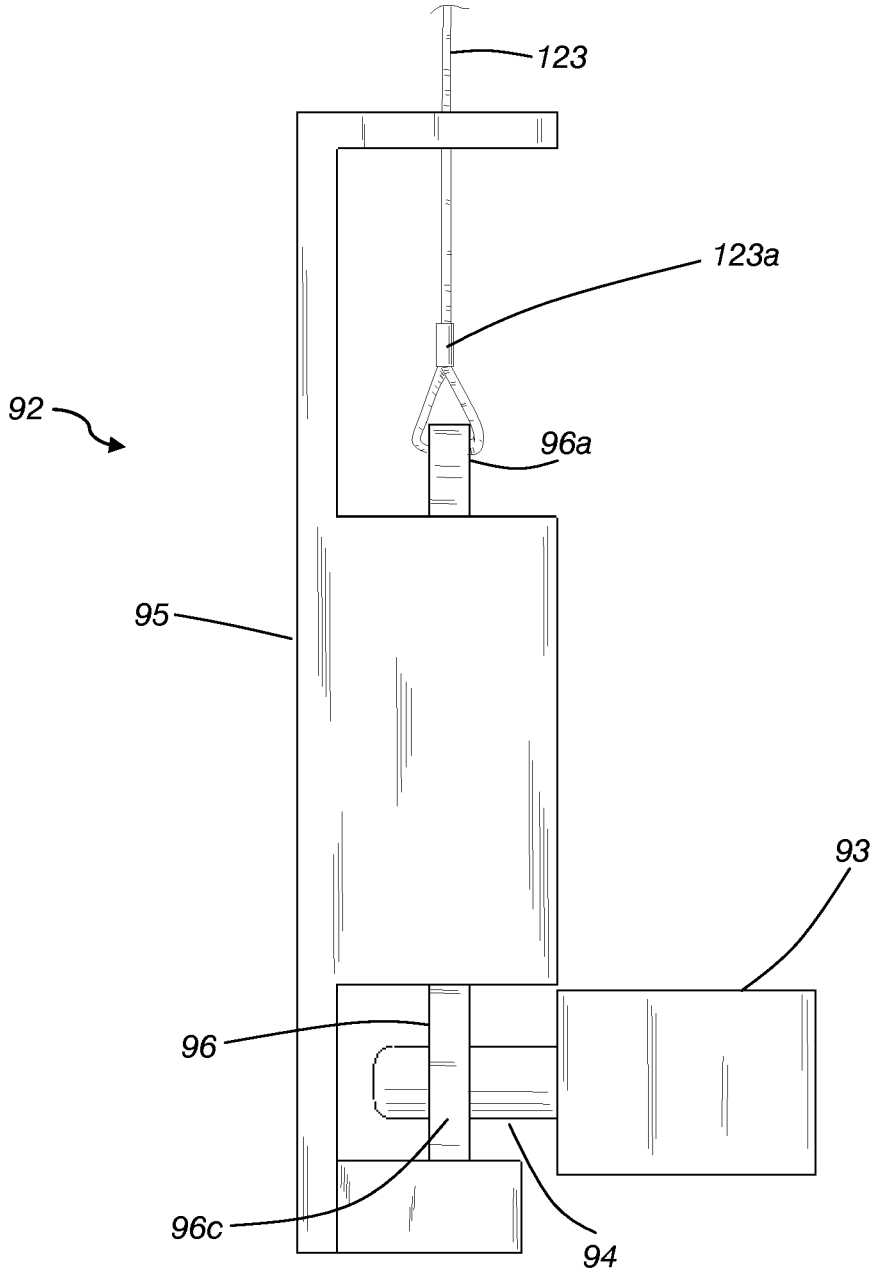
FIG. 8 is a side view of a means for latching according to the embodiment of FIG. 1.

Referring to FIGS. 6-8, a means for latching 90 has a latching post 91, a mechanical latch 92, latch pin housing 93, and latch pin 94. Latching post 91 is fixedly attached to the ground and extends longitudinally parallel relative to support post 12, located proximate to gate latch side 62. Latch pin housing 93 extends concentrically around latch gate side 62. Latch pin 94 extends longitudinally perpendicular from latch pin housing 93 into mechanical latch 92. Mechanical latch 92 is fixed to latching post 91, and has a housing member 95, a first latch plate 96, and a second latch plate 97. First latch plate 96 and second latch plate 97 have stopping surfaces 96*b*, 97*b*, and apertures 96*a*, 97*a*, and angled surfaces 96*c*, 97*c*. According to the preferred embodiment, control structures 120 are located at opposing sides of the gate 60, as illustrated in FIG. 2. Engagement of either control structure 120 allows opening of gate 60.

Figure 3:
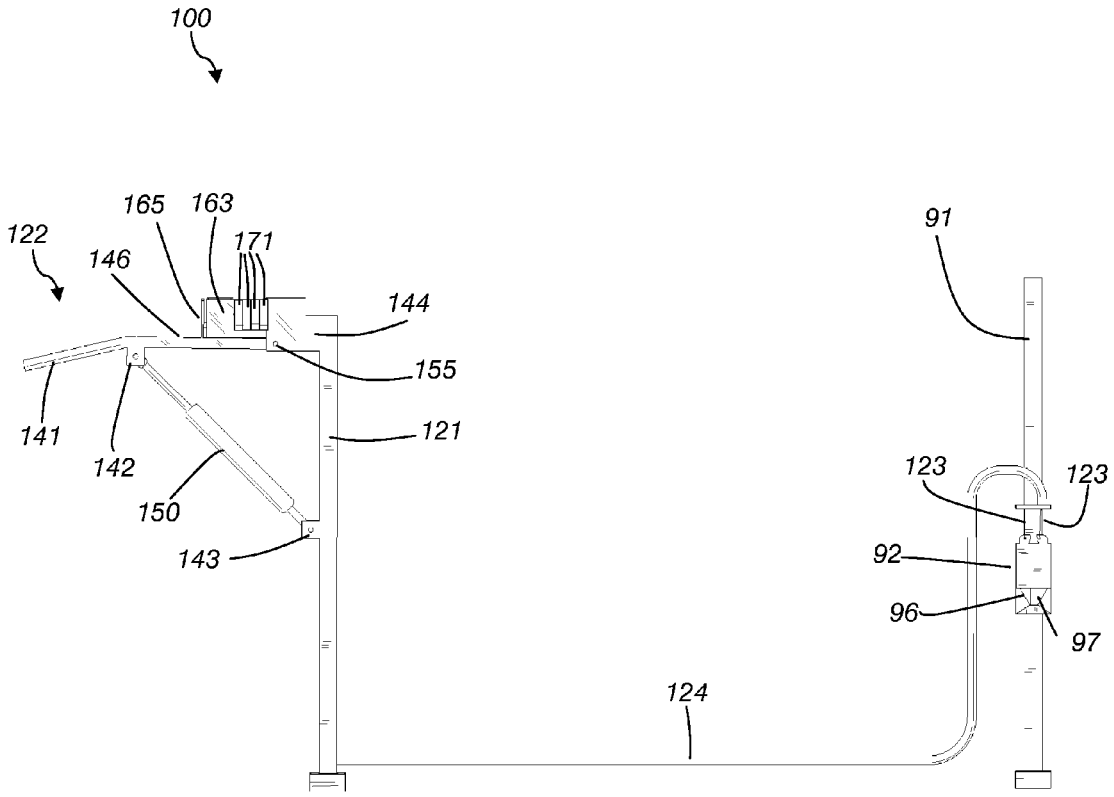
FIG. 3 is a side view of a control means and a means for latching according to the embodiment of FIG. 1.
Figure 4:
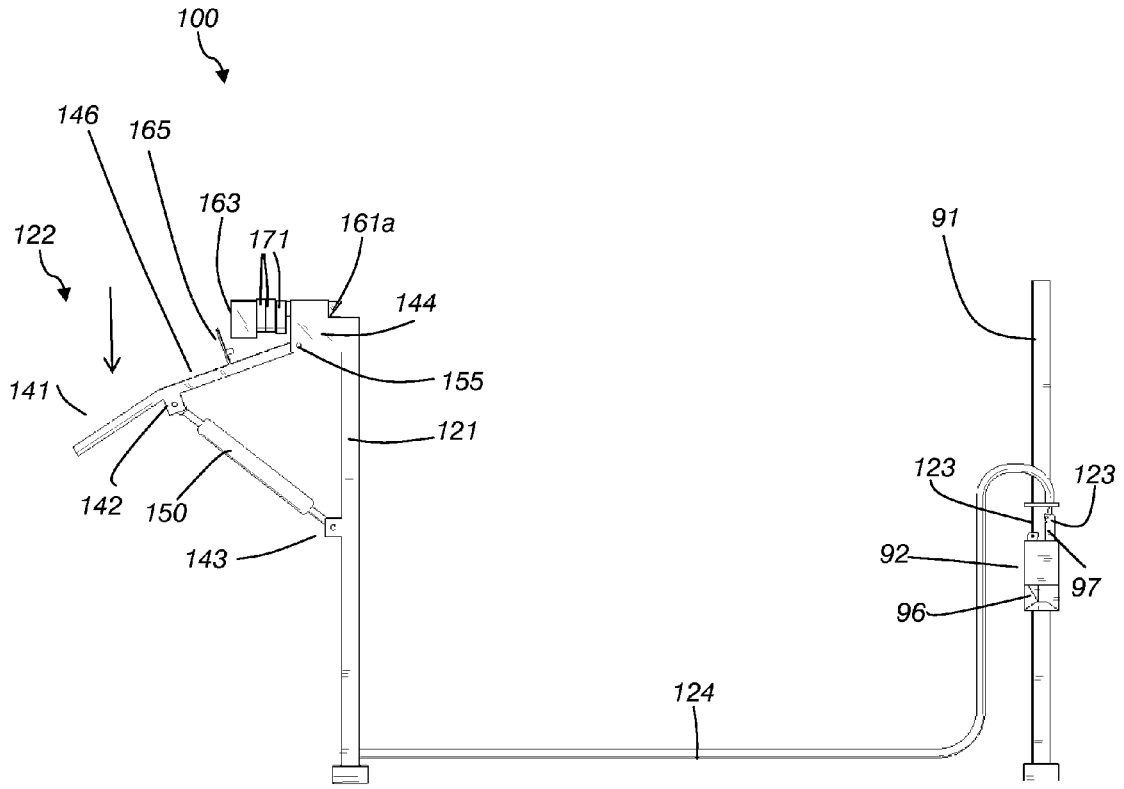
FIG. 4 is a side view of a control means and a means for latching, showing activation, according to the embodiment of FIG. 1.
Figure 5:
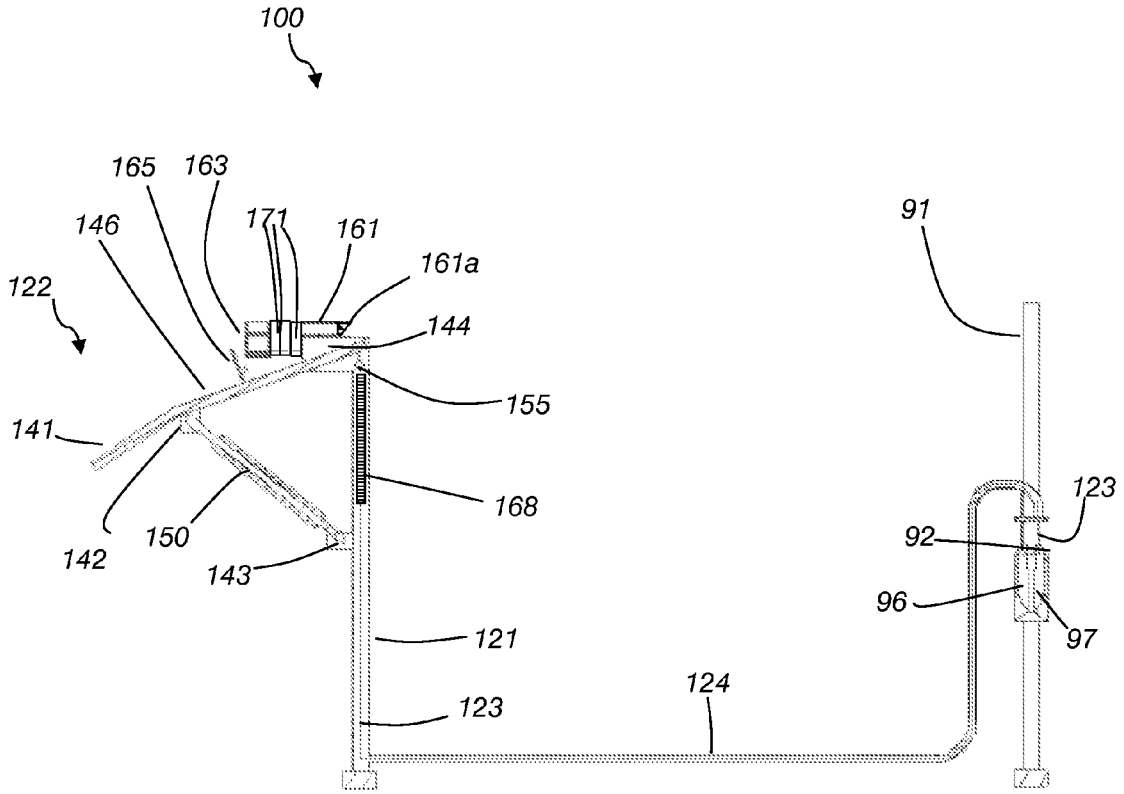
FIG. 5 is a partial cross-sectional side view of a control means and a means for latching, showing activation, according to the embodiment of FIG. 1.

Referring to FIGS. 3-5, engagement of control structure 120 causes lifting cable 123 to retract towards control structure 120, thereby providing lift to means for latching 90. Lifting cable 123 is connected to first latch plate 96 and second latch plate 97, through aperture 96*a*, 97*a*, secured by crimp clips 123*a*. Lifting cable housing 124 is a protective sheathing, which can be located above or below the surface of the ground. The path of the lifting cable housing 124 between control structures 120 to means for latching 90 can vary. Each control structure 120 engages either first latch plate 96 or second latch plate 97. Control structure 120 engages first latch plate 96 or second latch plate 97, as shown in FIGS. 3-5.

Referring to FIG. 3, control structure 120 has a lifting cable 123 is attached to second latch plate 97 at aperture 97*a*. Before engagement of control structure 120, latch pin 94 rests between first latch plate 96 and second latch plate 97.

Referring to FIG. 4, engagement of control means 120 causes lifting cable 123 to raise second latch plate 97 from housing member 95. Latch pin 94 is then capable of moving in one direction (opposing movement is restricted by stopping surface 96*b*) respective of mechanical latch 92, and gate 60 is then allowed to move from closed to open position.

Second latch plate 97 is then lowered back into housing member 95. As gate 60 moves from open to closed position, latch pin 94 slidably lifts second latch plate 97 by sliding along angled surface 97*c*. Latch pin 94 slides between first latch plate 96 and second latch plate 97, and further movement is stopped by stopping surface 96*a*.

After a sliding spacer is removed, the driver then depresses the lift handle, which elevates the lifting cable. One latch plate rises, and gate is allowed to swing in one direction. An operator then replaces the sliding spacer (and corresponding lock) and releases the lift handle. The hydraulic strut decompresses slowly, causing a time delay between activation and descent of lifting cable and latch plate.

Figure 22:
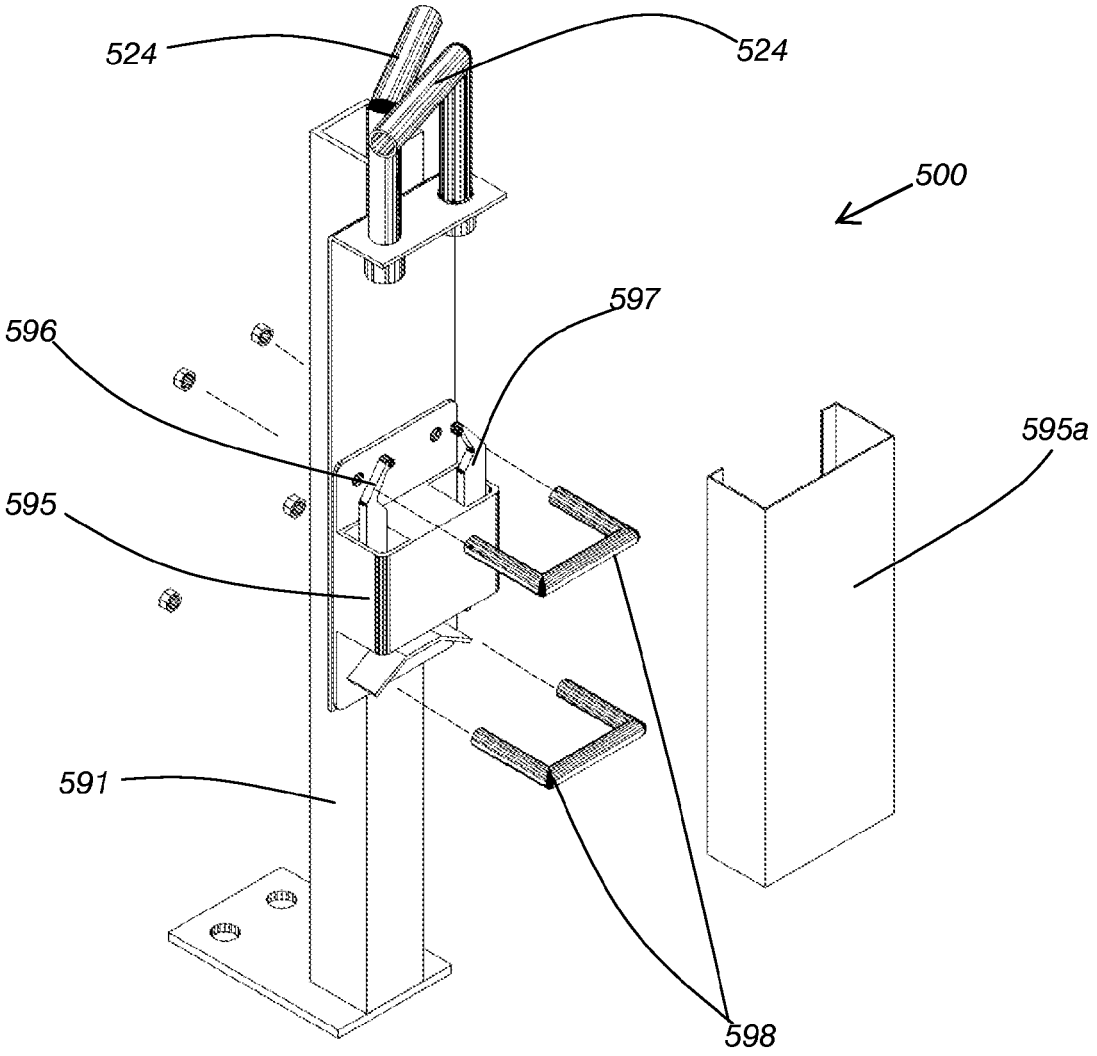
FIG. 22 and FIG. 23 are exploded perspective views of an alternative embodiment, showing a means for latching.
Figure 23:
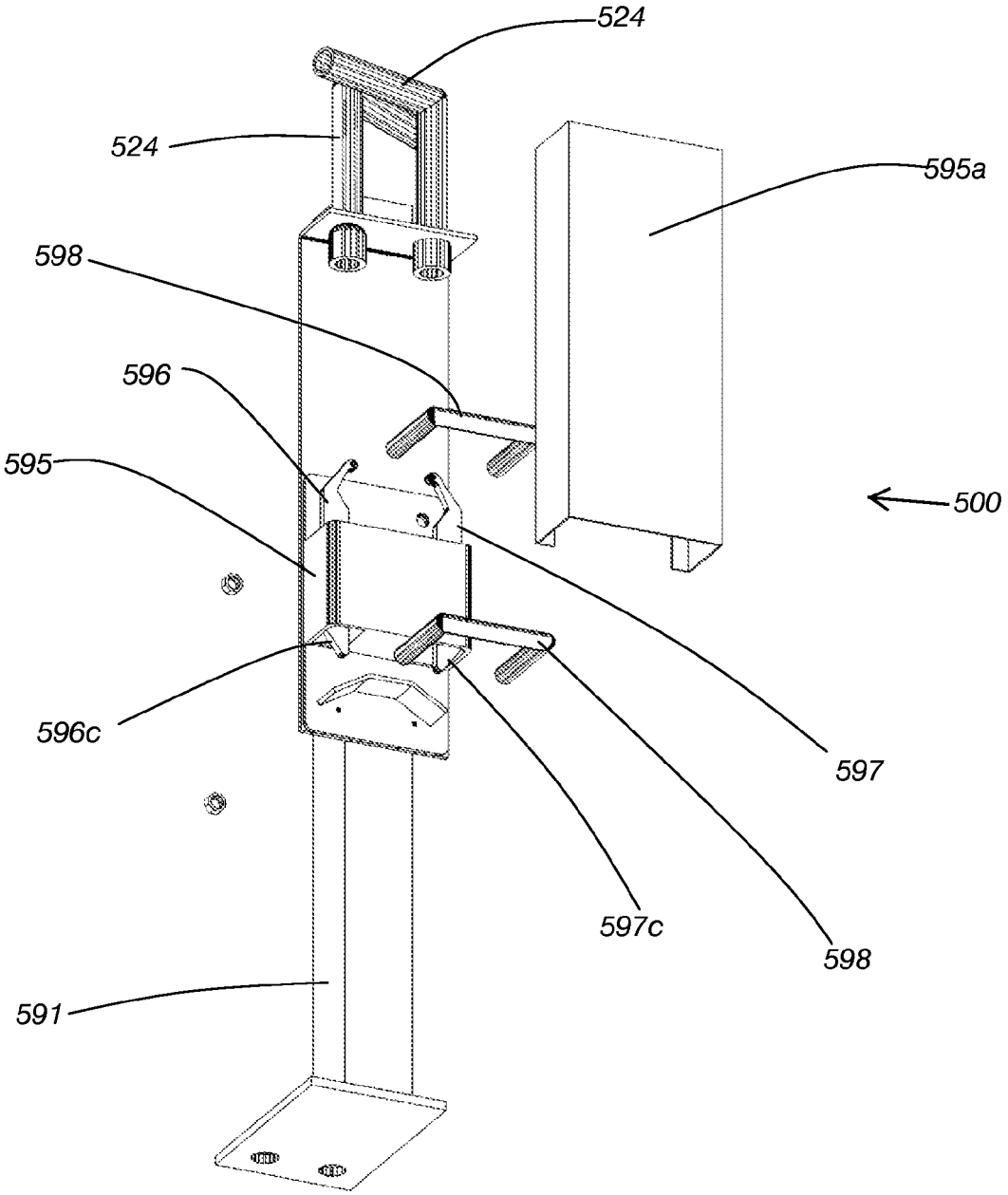

In a further embodiment, a control mechanism 500 has a means for lifting 122, a lifting cable 123, and lifting cable housing 124 a set forth. The embodiment further comprises a latching post 591, a mechanical latch 592, lifting cable housing 524, housing member 595, housing member security panel 595*a*, angled surfaces 596*c*, 597*c*, U-bolt member 598, latch pin housing 593, and latch pin 594 as shown in FIGS. 22-23.

Any element in a claim that does not explicitly state "means for" performing a specified function, or "step for" performing a specific function, is not to be interpreted as a "means" or "step" clause as specified in 35 U.S.C. §112, ¶ 6. In particular, the use of "step of" in the claims herein is not intended to invoke the provisions of 35 U.S.C. §112, ¶ 6.

What is claimed is:

1. A control mechanism comprising:

a means for lifting, further comprising:

a control post;

a lift handle attached to a lift body frame about a lift pivot, said lift body frame extending longitudinally perpendicular from said control post;

an at least one spring mechanism, wherein one end of said spring mechanism is attached to said lift body frame;

an upper lift pivot attached to said lift body frame;

a lower lift pivot attached to said control post;

a hydraulic strut extending between said upper lift pivot and said lower lift pivot;

a lift housing member, attached at an upper portion of said control post, said lift housing member further comprising a slide rail housing;

a slide rail extending from a roller housing through said slide rail housing;

a roller, said roller resting between a roller pin and a set pin within said roller housing;

wherein said roller, said roller pin, and said set pin extend longitudinally within said roller housing, said roller circumposing said roller pin and resting upon said set pin;

a set plate attached to said lift body frame proximate to a front outer surface of said roller housing;

a lock pin extending longitudinally perpendicular from said set plate for engagement in a recess cavity, said recess cavity located on said front outer surface of said roller housing, and extending onto a lower surface of said roller housing;

a plurality of spacing sliders, wherein removal of one or more of said spacing sliders allows said roller housing and said slide rail to move towards said lift housing member, freeing said lock pin from said recess cavity, thereby allowing rotation of said lift body frame and compression of said hydraulic strut; and wherein replacement of one or more of said spacing sliders allows said roller housing and said slide rail to move away from said lift housing member, thereby allowing rotation of said lift body frame and decompression of said hydraulic strut, further rotation of said lift body frame causing said lock pin to move into a locked position within said roller housing, wherein said lock pin rests upon said roller, and said set plate rests against said roller housing.

2. The control mechanism of claim 1, further comprising a lifting cable attached to said lifting means.

3. The control mechanism of claim 2, wherein said lifting cable extends through a lifting cable housing.

4. The control mechanism of claim 3, wherein engagement of engagement of said control mechanism by an operator applies a directional force on said lifting cable, said control mechanism causing said lifting cable to return to a first position over a period of time without further interaction from said operator.

5. The control mechanism of claim 4, wherein said period of time is defined by the rate of decompression of said hydraulic strut.

6. The control mechanism of claim 1, wherein said roller pin and said set pin are positioned relative to said roller to allow rotation of roller, and to prohibit precession of said roller over said roller pin.

7. The control mechanism of claim 1, comprising four spacing sliders.

8. A control mechanism comprising:

a means for lifting, further comprising:

a control post;

a lift handle attached to a lift body frame about a lift pivot, said lift body frame extending longitudinally perpendicular from said control post;

an at least one spring mechanism, wherein one end of said spring mechanism is attached to said lift body frame, and an opposing end of said spring mechanism is attached to a lifting cable;

an upper lift pivot attached to said lift body frame;

a lower lift pivot attached to said control post;

a hydraulic strut extending between said upper lift pivot and said lower lift pivot;

a lift housing member, attached at an upper portion of said control post, said lift housing member further comprising a slide rail housing;

a slide rail extending from a roller housing through said slide rail housing;

a roller, said roller resting between a roller pin and a set pin within said roller housing;

wherein said roller, said roller pin, and said set pin extend longitudinally within said roller housing, said roller circumposing said roller pin and resting upon said set pin;

a set plate attached to said lift body frame proximate to a front outer surface of said roller housing;

a lock pin extending longitudinally perpendicular from said set plate for engagement in a recess cavity, said recess cavity located on said front outer surface of said roller housing, and extending onto said lower surface of said roller housing;

a plurality of spacing sliders, wherein removal of one or more of said spacing sliders allows said roller housing and said slide rail to move towards said lift housing member, freeing said lock pin from said recess cavity, thereby allowing rotation of said lift body frame and compression of said hydraulic strut;

wherein replacement of one or more of said spacing sliders allows said roller housing and said slide rail to move away from said lift housing member, thereby allowing rotation of said lift body frame and decompression of said hydraulic strut, further rotation of said lift body frame causing said lock pin to move into a locked position within said roller housing, wherein said lock pin rests upon said roller, and said set plate rests against said roller housing; and a means for latching.

9. The control mechanism of claim 8, further comprising a lifting cable housing.

10. The control mechanism of claim 8, wherein said lifting cable extends from said spring mechanism through said control post, extending through a lifting cable housing, and attached to said means for latching.

11. The control mechanism of claim 10, wherein said means for latching comprises:

a latching post located at one side of a gate;

a housing member fixedly attached to said latching post;

a mechanical latch located within said housing member, further comprising a first plate and second latch plate, wherein first latch plate and second latch plate each define stopping surfaces, apertures, and angled surfaces;

a latch pin located between said first latch plate and said second latch plate in a closed position;

wherein activation of said control mechanism causes said lifting cable to contract, thereby elevating either first latch plate or second latch plate within said housing member, elevation of either first latch plate or second latch plate allowing said latch pin to exit said housing member; and wherein disengagement of said control mechanism causes said lifting cable to retract away from said lifting means over a predetermined time period, said predetermined time period defined by a decompression rate of hydraulic strut, thereby causing either said first latch plate or second latch plate to descend into s aid housing member.

12. The control mechanism of claim 8, further comprising a horizontally swinging type gate.

13. The control mechanism of claim 8, wherein said roller pin and said set pin are positioned relative to said roller to allow rotation of roller, and to prohibit precession of said roller over said roller pin

14. The control mechanism of claim 8, comprising four spacing sliders.

15. A control mechanism comprising:

a means for lifting, further comprising:

a control post;

a lift handle attached to a lift body frame about a lift pivot, said lift body frame extending longitudinally perpendicular from said control post;

an at least one spring mechanism, wherein one end of said spring mechanism is attached to said lift body frame, and an opposing end of said spring mechanism is attached to a lifting cable;

an upper lift pivot attached to said lift body frame;

a lower lift pivot attached to said control post;

a hydraulic strut extending between said upper lift pivot and said lower lift pivot;

a lift housing member, attached at an upper portion of said control post, said lift housing member further comprising a slide rail housing;

a slide rail extending from a roller housing through said slide rail housing;

a roller, said roller resting between a roller pin and a set pin within said roller housing;

wherein said roller, said roller pin, and said set pin extend longitudinally within said roller housing, said roller circumposing said roller pin and resting upon said set pin;

a set plate attached to said lift body frame, proximate to a front outer surface of said roller housing;

a lock pin extending longitudinally perpendicular from said set plate for engagement in a recess cavity, said recess cavity located on said front outer surface of said roller housing and extending onto said lower surface of said roller housing;

a plurality of spacing sliders, wherein removal of one or more of said spacing sliders allows said roller housing and said slide rail to move towards said lift housing member, freeing said lock pin from said recess cavity, thereby allowing rotation of said lift body frame and compression of said hydraulic strut;

wherein replacement of one or more of said spacing sliders allows said roller housing and said slide rail to move away from said lift housing member, thereby allowing rotation of said lift body frame and decompression of said hydraulic strut, further rotation of said lift body frame causing said lock pin to move into a locked position within said roller housing, wherein said lock pin rests upon said roller, and said set plate rests against said roller housing; and a means for latching, comprising:

a latching post located at one side of a gate;

a housing member fixedly attached to said latching post;

a mechanical latch located within said housing member, further comprising a first plate and second latch plate, wherein first latch plate and second latch plate each define stopping surfaces, apertures, and angled surfaces;

a latch pin located between said first latch plate and said second latch plate in a closed position;

wherein activation of said control mechanism causes said lifting cable to contract, thereby elevating either first latch plate or second latch plate within said housing member, elevation of either first latch plate or second latch plate allowing said latch pin to exit said housing member; and wherein disengagement of said control mechanism causes said lifting cable to retract away from said lifting means over a predetermined time period, said predetermined time period defined by a decompression rate of hydraulic strut, thereby causing either said first latch plate or second latch plate to descend into s aid housing member.

16. The control mechanism of claim 15, wherein said lifting cable extends through a lifting cable housing.

17. The control mechanism of claim 16, wherein said lifting cable extends from said spring mechanism through said control post, extending through said lifting cable housing, and attached to said means for latching.

18. The control mechanism of claim 15, further comprising a horizontally swinging type gate.

19. The control mechanism of claim 15, wherein said roller pin and said set pin are positioned relative to said roller to allow rotation of roller, and to prohibit precession of said roller over said roller pin.

20. The control mechanism of claim 15, further comprising a latch pin housing member attached to said latch pin.

* * * * *